United States Patent [19]

Kawamura et al.

[11] 4,094,464

[45] June 13, 1978

[54] THREE DIMENSIONAL DISPLAY DEVICE USING WATER FOUNTAIN

[76] Inventors: Koichi Kawamura; Yoshiko Kawamura, both of No. 66, Jomyoji, Kamakura City, Japan

[21] Appl. No.: 739,104

[22] Filed: Nov. 5, 1976

[30] Foreign Application Priority Data

Nov. 14, 1975 Japan ..... 50-136351

[51] Int. Cl.[2] ..... B05B 17/08

[52] U.S. Cl. ..... 239/17; 239/211; 239/551; 40/449; 58/2

[58] Field of Search ..... 239/16–23, 239/211, 551, 12; 40/28 C, 106.21, 137, 217; 58/1 R, 2

[56] References Cited

U.S. PATENT DOCUMENTS

| | | | |
|---|---|---|---|
| 1,747,377 | 2/1930 | Maxon | 239/18 X |
| 1,762,126 | 6/1930 | Smith | 239/20 X |
| 2,594,877 | 4/1952 | Crockett | 239/18 X |
| 3,635,402 | 3/1970 | Kawamura et al. | 239/18 |
| 3,640,463 | 2/1972 | Kawamura et al. | 239/17 |

*Primary Examiner*—Robert W. Saifer

[57] ABSTRACT

A water fountain device having stepwisely arranged nozzles in matrix. The water fountain may be displayed to express clock, characters or notations under control of electromagnetic valves controlled by program in a controller. The display is in three dimension so that it is very easy to be seen from the ground level.

7 Claims, 42 Drawing Figures

THREE DIMENSIONAL DISPLAY DEVICE USING WATER FOUNTAIN

BACKGROUND OF THE INVENTION

The present invention relates to a display device using liquid as the material for displaying characters or symbols in three dimensional scale.

An appreciative apparatus using water well known in the art is fountain. There are various kinds of fountains. Most typical fountains are those installed in parks or the like. Also music fountains operating and varying with rhythm of music are known. Recently, as a kind of digital display, a fountain clock has been developed.

As a recent tendency of purpose of providing a fountain, there is a requirement for use it as a media of advertisement. Therefore in the case of fountain clock, the requirement is slightly different from that of the conventional fountains or music fountains.

More practical, social, fresh and visual functions are requested in such a fountain clock, in view of effect for use it as a media of advertisement.

There has been a proposal for a fountain clock. Such a known fountain clock has usually planar visual display function. The planar fountain clock has a limitation in that it can be seen properly only by those standing besides of it and from a limited area. In other words, the visual field thereof is very narrowly limited. From such a reason, the water level of a planar fountain clock is better to be lowered as far as possible. Should the water level is lifted up from the ground level, it may be limited to 50 cm at the most. Otherwise the display can hardly be seen by people.

SUMMARY OF THE INVENTION

The present invention has for its object to realize a dramatically novel three dimensional display device using liquid for displacing digital numbers, symbols and/or characters.

The device according to the present invention can eliminate disadvantages of the aforementioned planar fountain clock particularly in its limited observation field. The invention is intended to achieve a device being used in a novel display field which has not been satisfied by conventional display means using mainly electric devices, such as, neon tube display devices, electric flash light displays, etc.

DESCRIPTION OF PREFERRED EMBODIMENTS

In order to afford a clearer understanding of the present invention, the various embodiments thereof will be explained by referring to the accompanied drawings.

Figure 1:
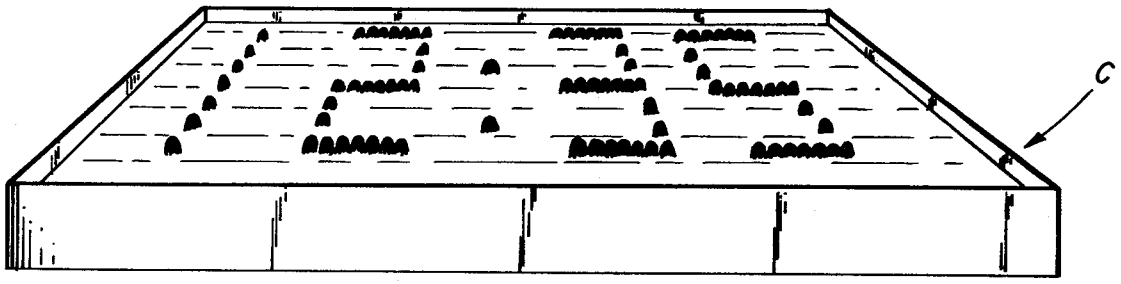
FIG. 1 PRIOR ART
FIG. 1 is a perspective view of a conventional fountain clock.
Figure 2:
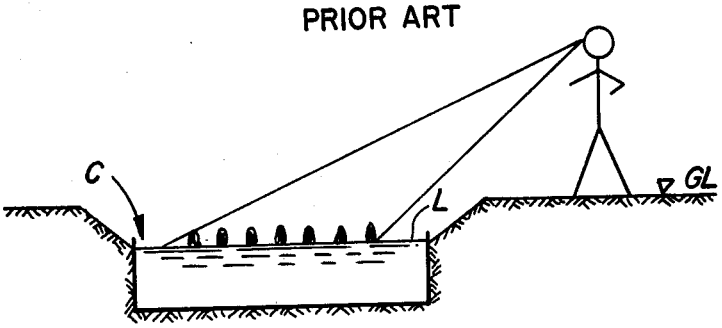
FIG. 2 PRIOR ART
FIGS. 2 to 4 are diagrammatic illustrations for explaining observation views of the fountain clock shown in FIG. 1.
Figure 3:
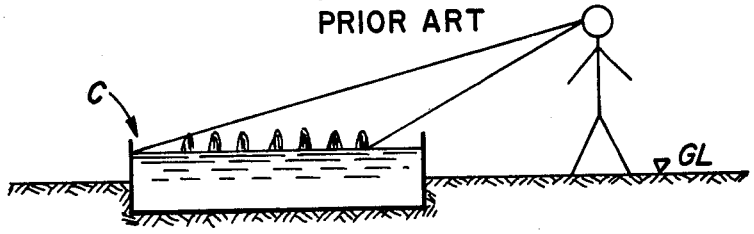
FIG. 3 PRIOR ART
Figure 4:
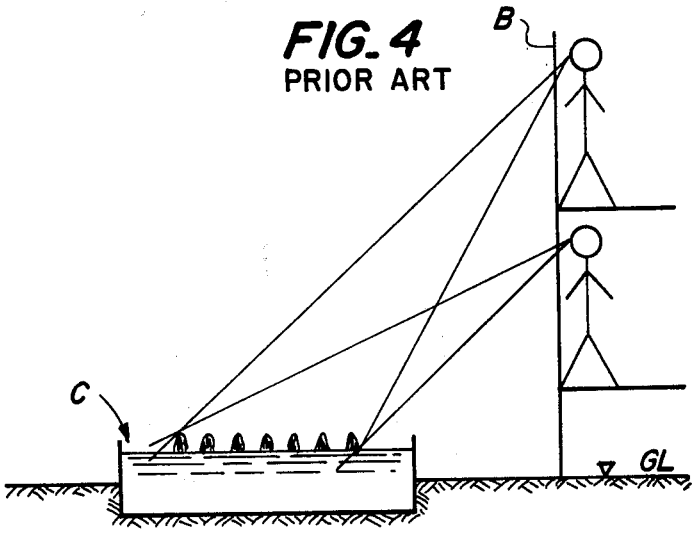
FIG. 4 PRIOR ART

FIGS. 1–4 illustrate a conventional fountain clock C and the manner by which it may be observed. This fountain clock varies the display numbers according to time phrases. FIGS. 2 to 4 explain the various observing positions for the fountain clock shown in FIG. 1. FIG. 2 is a most suitable arrangement, in which the water level L is below the ground level. FIG. 3 shows an arrangement, in which the water level is raised above ground level. Considering the viewing field, the maximum height of the water level is limited up to about 50 cm. In some instances, it is only possible for the fountain to be observed from a higher location, for instance, from the 2nd or 3rd floor of a building B as shown in FIG. 4.

Figure 5:
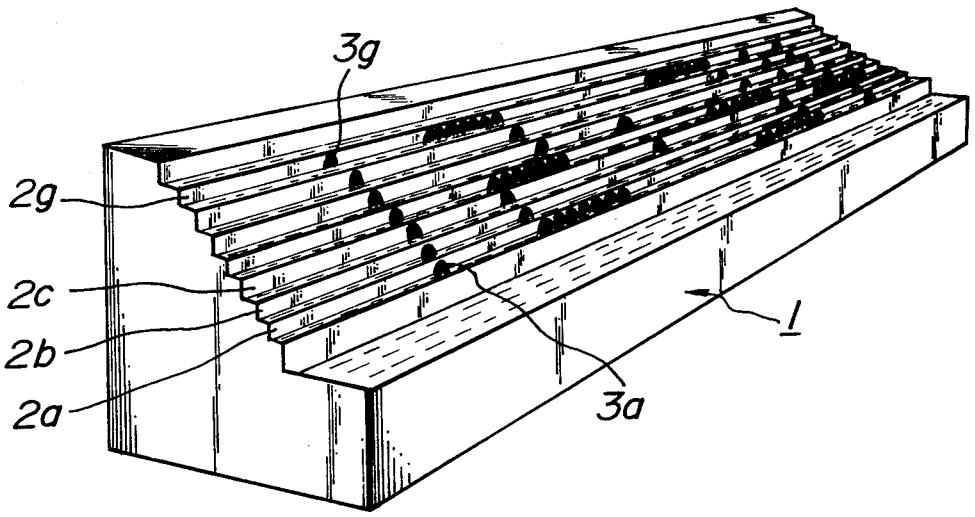
FIG. 5 is a perspective view of an embodiment of the display device according to the present invention.

FIG. 5 shows one embodiment of the device of the present invention. As can be seen from FIG. 5, the water level is arranged in a series of steps. In other words, over a base pond 1, upper ponds 2a, 2b, 2c . . . 2g are stacked in stepwise fashion. The upper ponds have water jet nozzles installed therein, by means of which display jet groups 3a to 3g can be ejected discharged to indicate desired time or other designations.

Figure 6:
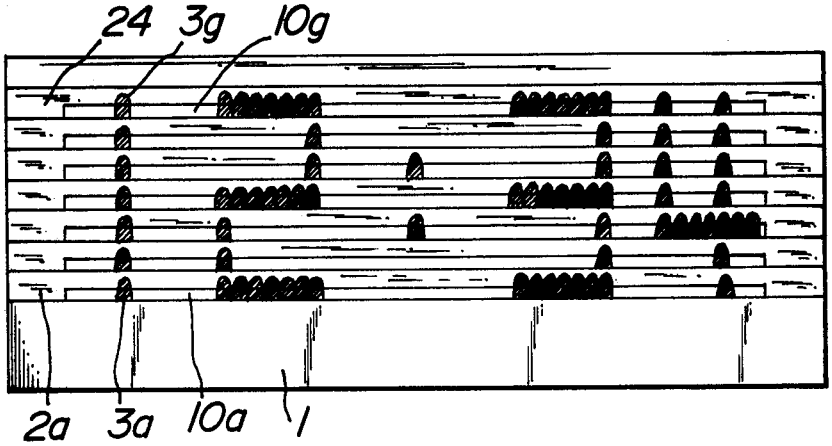
FIG. 6 is a front view of the device shown in FIG. 5.
Figure 7:
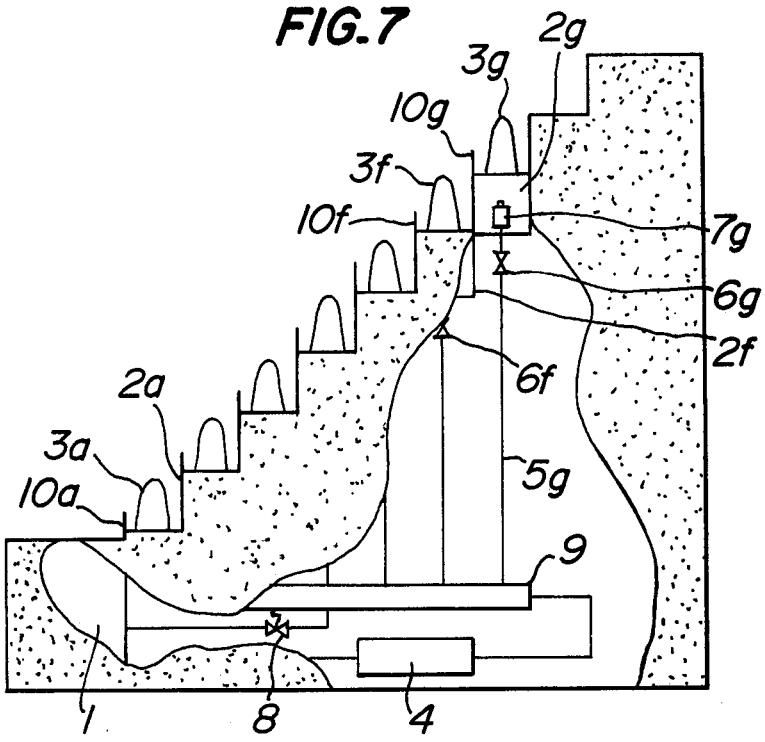
FIG. 7 is a side elevation partial in cross-section thereof.

FIG. 6 is a front view of the device shown in FIG. 5 and FIG. 7 is a side elevation partially in cross-section.

As can be seen from the cross-sectional view shown in FIG. 7, the device of the present invention comprises a motor pump 4 which pumps up the water in the base pond 1 and supplies the water through a pipe system to a tank 9. From the tank 9, groups of water supply tubes 5a to 5g extend and terminate in respective groups of nozzles 7a to 7g. Each of the water supply tubes 5a to 5g is provided with respective electromagnetic valves 6a to 6g. In the drawing only part of such water supply tubes, nozzles and valves are shown. By operating the electromagnetic valves 6a to 6g selectively, the jets of water 3a to 3g can be controlled selectively.

Although not illustrated in FIG. 7, by providing respective manual valves between the electromagnetic valves and the motor pump 4, differences in flow rate can be adjusted more exactly.

The tank 9 is provided to adjust the water pressure for each tube so as to be constant.

An electromagnetic valve 8 for pressure control is provided between the tank 9 and the base pond 1. This means that if the number of the electromagnetic valve groups 6a to 6g opened is small, the water pressure becomes high and the water jet becomes correspondingly higher so that the pressure regulating valve operates in such instances to discharge the water to the base pond 1 and to adjust the height of the display water jets 3a to 3g accordingly.

In such a water fountain display, when the displaying water jet 3g in the upper pond 2g is discharged, waves in the upper pond 2g might occur which may drop to the next pond 2f and thereby vary the water level therein and which in turn will affect the height of the water jet 3f so as to be higher or lower. This would cause the water jet display groups as a whole to be unclear. This is more noticeable if one lateral row of jet nozzles are to be discharged and the next lower pond level is affected by the water fall.

In order to prevent such disturbances, a transparent plate 10g for display may be provided in front of the pond 3g. The plate may be made of a transparent plastic such as acrylic resin, or it may be made of glass. The corresponding plates 10a to 10f are provided for respective upper ponds 3a to 3f. By the provision of such display plates the water is prevented from falling to the next lower level pond thereby insuring a clearer display.

Figure 8:
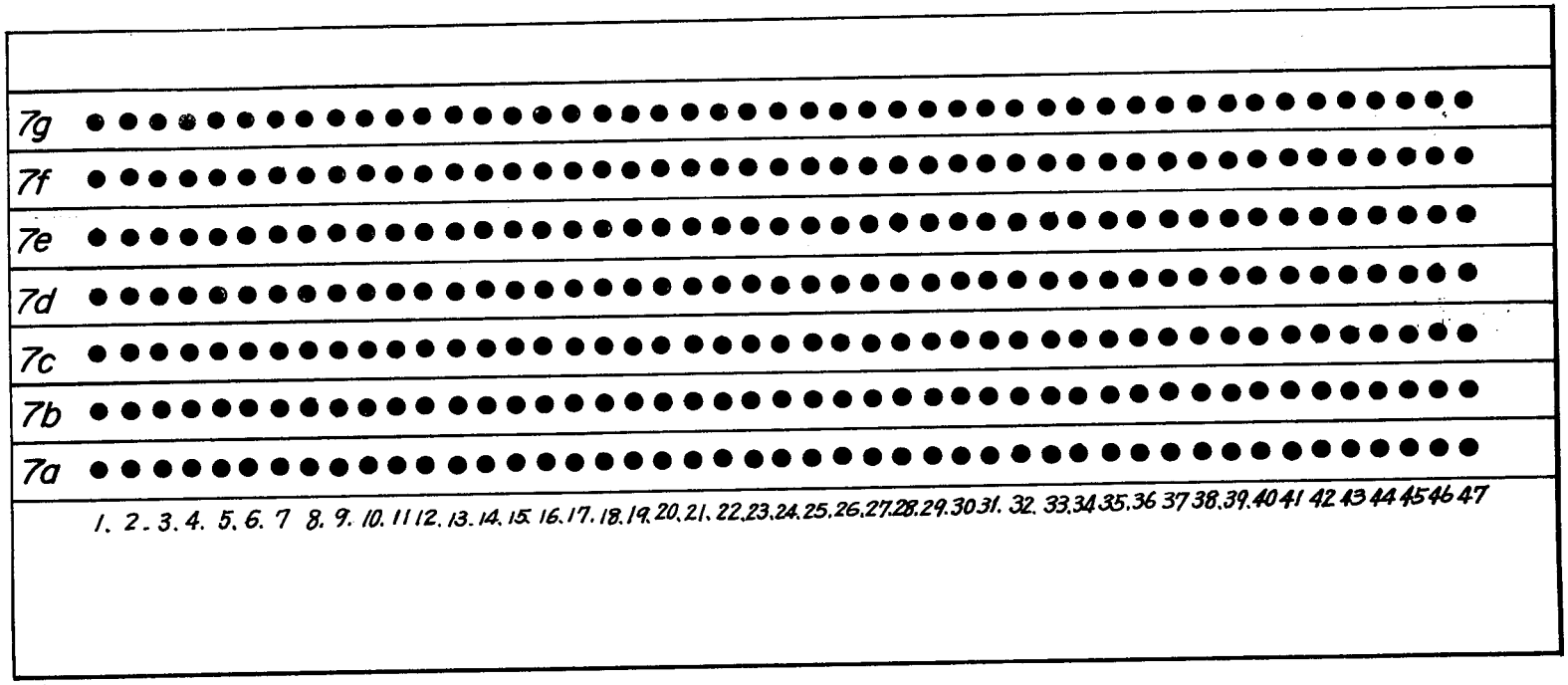
FIG. 8 is a diagram showing arrangement of nozzles of the device shown in FIG. 5.

FIG. 8 shows the disposition of nozzles used in the display device of FIG. 7.

As can be seen from FIG. 8, a plurality of nozzles are arranged in rows and columns as designated by the numbers 7a to 7g and 1 to 47.

By using the arrangement of the nozzles, arbitrary characters or notations, etc. can be displayed by the fountain.

The displays shown in FIGS. 9A to 9C will now be described.

Figure 9A:
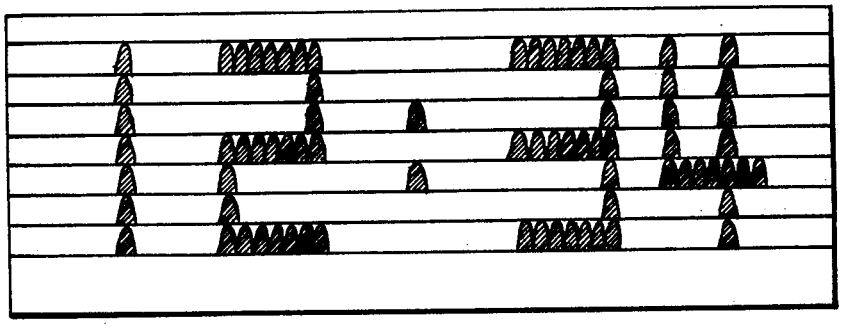
FIGS. 9A to 9C show several modes of display taken in the front view of FIG. 5.
Figure 9B:
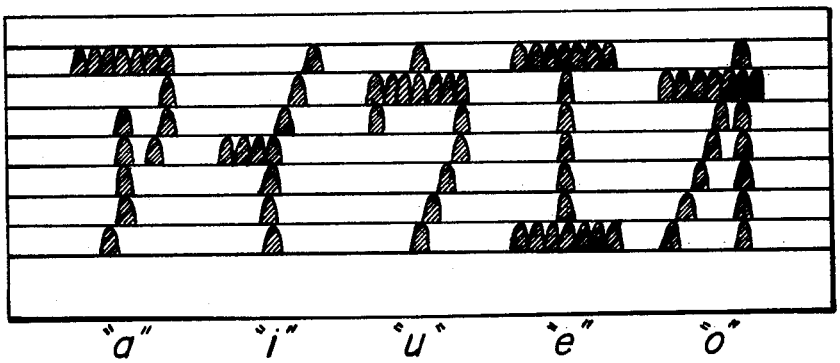
Figure 9C:
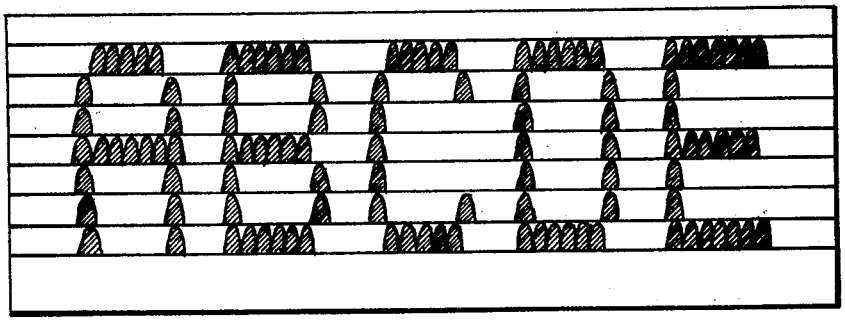

FIG. 9A is an example displaying time in digital manner. In the illustrated embodiment, the display shows 12 O'clock 34 minutes. FIG. 9B is an embodiment displaying Japanese characters and FIG. 9C is an example of a display of Roman characters (ABCDE).

In the figures, the clock, Japanese character and Roman character displays are shown separately. However, it will be understood that they may be combined in a single display or may be displayed alternately by one device.

For indicating the time as 12 O'clock 34 minutes, nozzles 7a-4, 7b-4, 7c-4, 7d-4, 7e-4, 7f-4, 7g-4 are operated to form numeral "1"; nozzles 7a-11, 12, 13, 14, 15, 16, 17, 7b-11, 7c-11, 7d-11, 12, 13, 14, 15, 16, 17, 7e-17, 7f-17, 7g-11, 12, 13, 14, 15, 16, 17 are operated to display numeral "2"; nozzles 7c-24 and 7e-24 are operated for the notation ":"; nozzles 7a-31, 32, 33, 34, 35, 36, 37, 7b-37, 7c-37, 7d-31, 32, 33, 34, 35, 36, 37, 7e-37, 7f-37, 7g-31, 32, 33, 34, 35, 36, 37 are operated for numeral "3"; and nozzles 7a-45, 7b-45, 7c-41, 42, 43, 44, 45, 46, 47, 7d-41, 45, 7e-41, 45, 7f-41, 45, 7g-41, 45 are operated for numeral "4". For providing water discharges from the above nozzles, corresponding electromagnetic valves in the valve groups 6a to 6g are operated.

Then when the Japanese characters having pronunciation "a," "i," "u," "e," "o" are to be displayed, corresponding electromagnetic valves are controlled to open to operate nozzles 7a-3, 7b-4, 7c-4, 7d-4, 6, 7e-4, 7, 7f-7, 7g-1, 2, 3, 4, 5, 6, 7 for "a"; nozzles 7a-14, 7b-14, 7c-14, 7d-11, 12, 13, 14, 7e-15, 7f-16, 7g-17, for "i"; nozzles 7a-24, 7b-25, 7c-26, 7d-27, 7e-21, 27, 7f-21, 22, 23, 24, 25, 26, 27, 7g-24 for "u;" nozzles 7a-31, 32, 33, 34, 35, 36, 37, 7b-34, 7c-34, 7d-34, 7e-34, 7f-34, 7g-31, 32, 33, 34, 35, 36, 37 for "e"; and nozzles 7a-41, 46, 7b-42, 46, 7c-43, 46, 7d-44, 46, 7e-45, 46, 7f-41, 42, 43, 44, 45, 46, 47, 7g-46 for "o."

Furthermore, if the characters "ABCDE" are to be displayed by the fountain, the corresponding electromagnetic valves are controlled to operate nozzles 7a-1, 7, 7b-1, 7 7c-1, 7, 7d-1, 2, 3, 4, 5, 6, 7, 7e-1, 7, 7f-1, 7, 7g-2, 3, 4, 5, 6 for "A"; nozzles 7a-11, 12, 13, 14, 15, 16, 7b-11, 17, 7c-11, 17, 7d-11, 12, 13, 14, 15, 16, 7e-11, 17, 7f-11, 17, 7g-11, 12, 13, 14, 15, 16 for "B;" nozzles 7a-22, 23, 24, 25, 26, 7b-21, 27, 7c-21, 7d-21, 7e-21, 7f-21, 27, 7g-22, 23, 24, 25, 26 for "C;" nozzles 7a-31, 32, 33, 34, 35, 36, 7b-31, 37, 7c-31, 37, 7d-31, 37, 7e-31, 37, 7f-31, 37, 7g-31, 32, 33, 34, 35, 36 for "D;" and nozzles 7a-41, 42, 43, 44, 45, 46, 47, 7b-41, 7c-41, 7d-41, 42, 43, 44, 45, 46, 47, 7e-41, 7f-41, 7g-41, 42, 43, 44, 45, 46, 47 for "E". As the result the displays of "12:34", Japanese characters "a, i, u, e, o" and "ABCDE" can be selectively shown by the fountain.

In the same manner as mentioned above, numerals, Katakana characters, or Roman characters can be displayed freely by the fountain.

Figure 10:
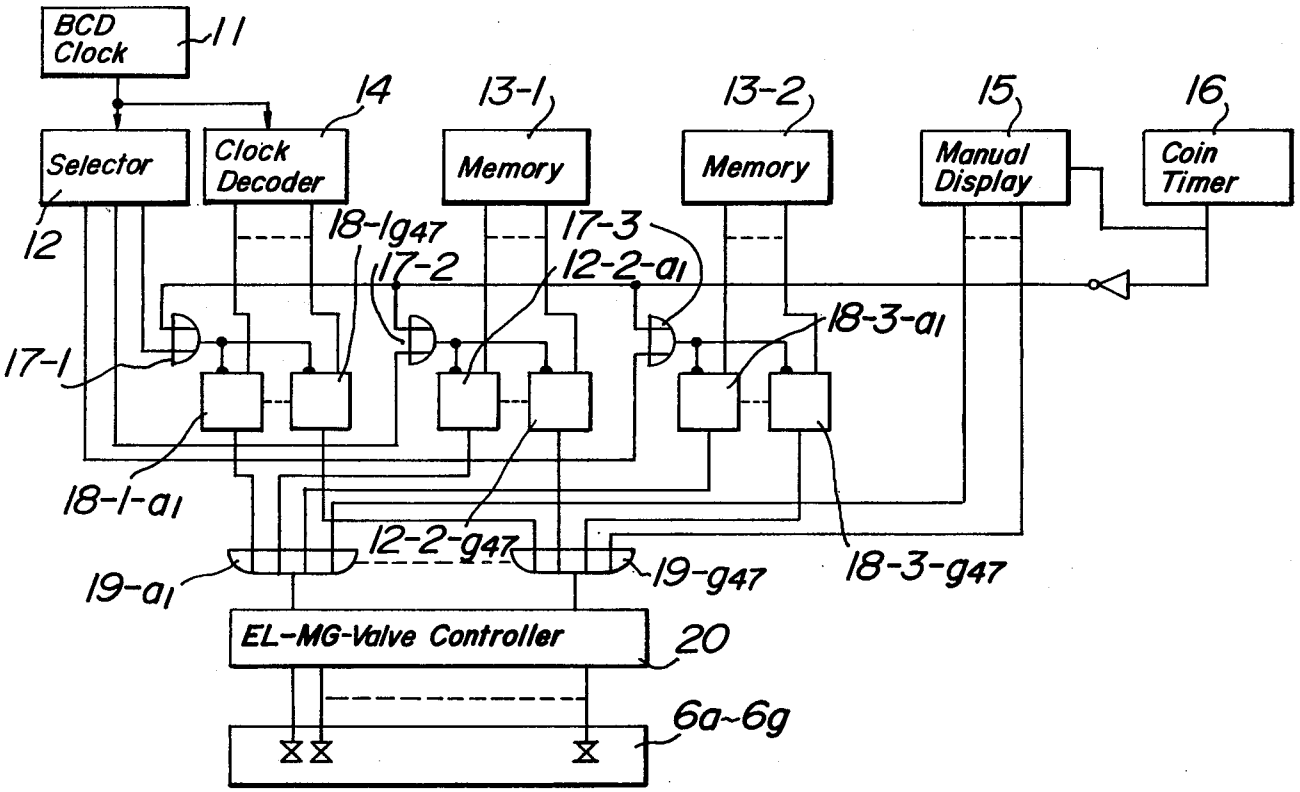
FIG. 10 is a block diagram of a control device used for the device shown in FIG. 5.

FIG. 10 illustrates a block diagram of an electric controlling device for operating the electromagnetic valve groups 6a to 6g shown in FIG. 5.

Figure 11:
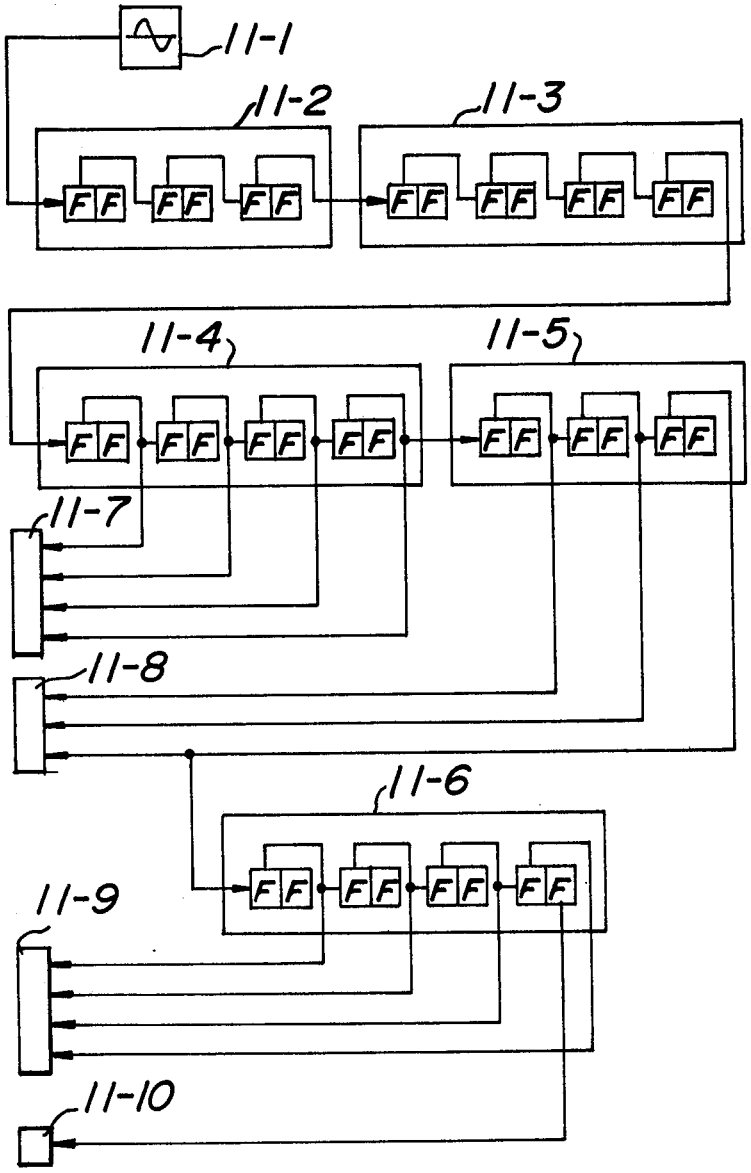
FIG. 11 is a detailed block diagram of a clock circuit shown in the diagram of FIG. 10.

In FIG. 11, a BCD output clock 11 delivers clock information as a triplicate parallel signals called BCD signals. A selector signal generator 12 is provided to determine whether the fountain is to serve as a display for time as a clock or for characters and notations or the like which may be stored in the memories 13-1 and 13-2.

Clock decoder 14 converts the BCD signal into digital display signals to form clock display signals.

The memories 13-1 and 13-2 store characters and notations or the like previously set for display.

Manual display device 15 operates only when it is supplied with a signal coming from a coin timer 16. This manual display device 15 is to produce signals to be displayed manually.

The coin timer 16 is to produce a predetermined signal by insertion of a coin or metal.

2-input OR gates 17-1, 17-2, 17-3 receive the selector signal from the selector signal generator 12 and a priority signal sent from the coin timer 16 and operate to decide the content of display by sending its signal to the selected one of prohibit gates (**18-1-*a*1 to 18-1-*g*47), (18-2-*a*1 to 18-2-*g*47), (18-3-*a*1 to 18-3-*g*47**).

4-input OR gates (**19-*a*1 to 19-*g*47) receive the display signal and an electromagnetic valve controller 20 controls electromagnetic valve groups 6*a* to 6*g***.

More details of the operation of the device will be given below.

The BCD output clock 11 is synchronized with the supply main and delivers 3 kinds of signals i.e. a minute signal representing 0–9 minute, a 10-minute signal representing 10–50 minute, and an hour signal representing 1–12 O'clock as BCD parallel signals. It is also possible to deliver signals representing 1–24 O'clock, 10–19 O'clock and 20–24 O'clock respectively. However, in this embodiment the signal is set up to read "12:59".

FIG. 11 is a more detailed block diagram of the clock 11.

In the drawing connecting terminals 11-7, 11-8, . . . 11-10 are the terminals for delivering the BCD parallel signal. The BCD output clock 11 comprises frequency dividers 11-2, 11-3, 11-4, 11-5 and 11-6. A commercial main frequency source 11-1 supplies a necessary voltage to the frequency divider 11-2 with a necessary output impedance. The frequency divider 11-2 is previously set to suit the commercial main frequency of either 50 Hz or 60 Hz and effects either 1/5 or 1/6 division of the supplied main frequency and delivers an output signal having 10 Hz frequency.

This 10 Hz signal is sent to the frequency divider 11-3 and it is divided into a ratio of 1/600 and changed into a signal of 1 minute one pulse signal. In the next frequency divider 11-4, the signal is further divided into 1/10 and 10 minute one pulse signal is provided. The above two pulse signals are sent to further stages. The BCD parallel signals representing 0 to 9 minute are sent to connector terminal 11-7. The 10 minute one pulse signal is delivered to the following frequency divider 11-5 and divided into 1/6 and provides BCD parallel signals representing 10 to 50 minute and 60 minute one pulse signal. The BCD parallel signal representing 10 to 50 minute are fed to connecting terminal 11-8 and the 60 minute one pulse signal is fed to the following frequency divider 11-6 and divided into ½ and a BCD parallel signals representing 1 to 12 O'clock and 10 to 12 O'clock. The BCD parallel signals representing 1 to 12 O'clock are sent to the connector terminal 11-9 and the 10 hour signal representing 10 to 12 O'clock is sent to connector terminal 11-10.

Figure 12:
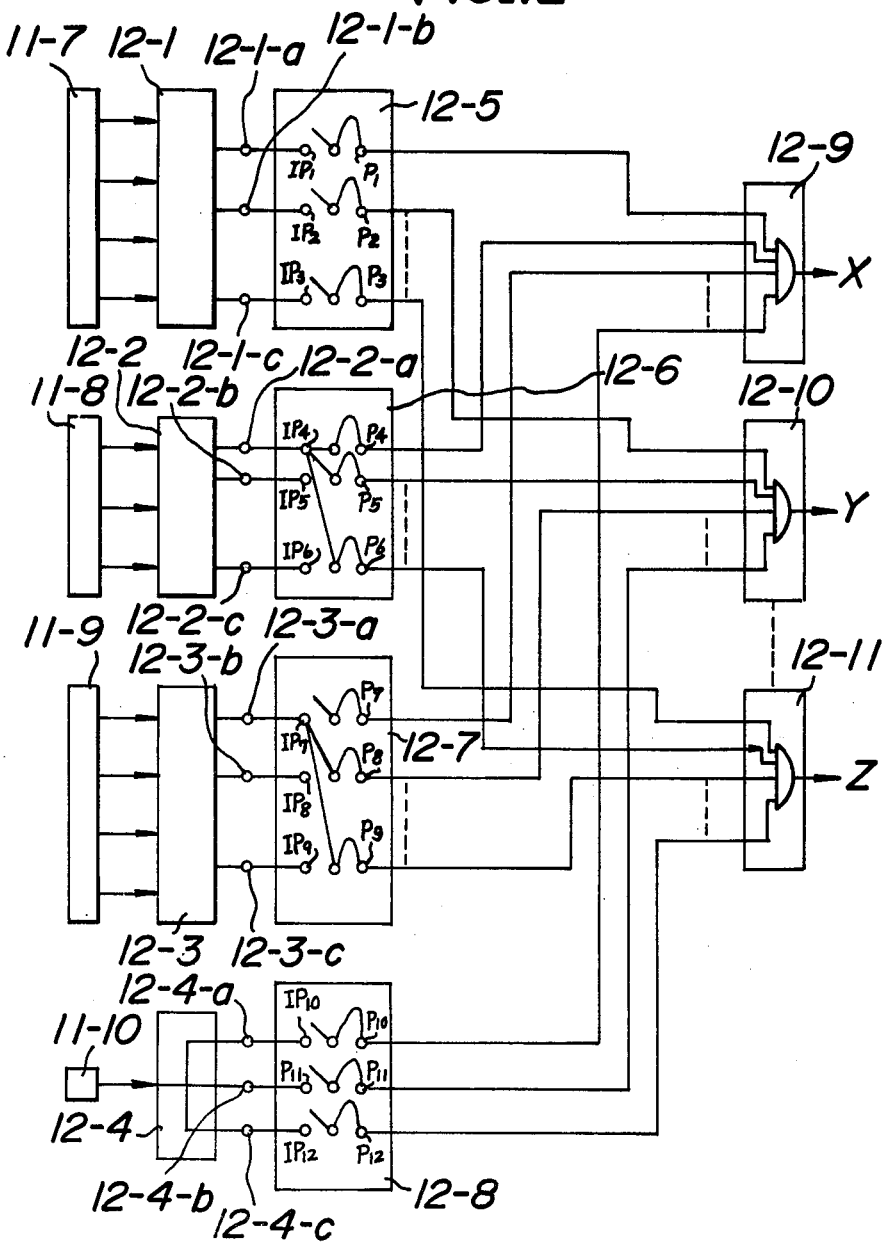
FIG. 12 is a detailed block diagram of a selector signal generator.

FIG. 12 is a detailed block diagram of the selector signal generator 12.

The BCD parallel signals sent from the connector terminals 11-7, 11-8, 11-9, 11-10 are decoded by decoders 12-1, 12-2, 12-3, 12-4 as shown by Table 1.

Output terminals **12-1-*a*, 12-1-*b*, 12-1-*c* of the decoder 12-1 are connected to respective input terminals of $IP_1$, $IP_2$, $IP_3$ of a connector 12-5 comprising combination pins. Output terminals 12-2-*a*, 12-2-*b*, 12-2-*c* of the decoder 12-2 are connected to input terminals $IP_4$, $IP_5$, $IP_6$ of a connector 12-6 comprising combination pins. Output terminals 12-3-*a*, 12-3-*b*, 12-3-*c* of the decoder 12-3 are connected to input terminals $IP_7$, $IP_8$, $IP_9$ of a connector 12-7 comprising combination pins and output terminals of the decoder 12-4 are connected to input terminals of a connector 12-8** also comprising combination pins.

One example of connection of the combination pins is as follows.

Pins $P_1$, $P_2$, $P_3$ of the connector 12-5 are not connected. The non-connected pin will give "1" output.

Connecting pins $P_4$, $P_5$, $P_6$ of the connector 12-6 are connected to the input terminal $IP_4$ and connecting pins $P_8$, $P_9$ of the connector 12-7 are connected to input terminal $IP_7$.

Table 1–1

| Time | BCD Parallel Signal for Minute DCBA | 12–1 a | b | c |
|---|---|---|---|---|
| 0 | 0000 | 0 | 0 | 0 |
| 1 | 0001 | 1 | 1 | 1 |
| 2 | 0010 | 0 | 1 | 1 |
| 3 | 0011 | 1 | 1 | 1 |
| 4 | 0100 | 0 | 0 | 1 |
| 5 | 0101 | 1 | 0 | 1 |
| 6 | 0110 | 0 | 0 | 0 |
| 7 | 0111 | 1 | 0 | 0 |
| 8 | 1000 | 0 | 0 | 0 |
| 9 | 1001 | 1 | 0 | 0 |
| | | 1 Minute Interval | 3 Minute Interval | 5 Minute Interval |

Table 1–2

| Time | BCD Parallel Signal for 10 Minute DCBA | 12–2 a | b | c |
|---|---|---|---|---|
| 00 Minute | 0000 | 0 | 0 | 0 |
| 10 Minute | 0001 | 1 | 0 | 0 |
| 20 Minute | 0010 | 0 | 1 | 0 |
| 30 Minute | 0011 | 0 | 1 | 1 |
| 40 Minute | 0100 | 0 | 0 | 1 |
| 50 Minute | 0101 | 0 | 0 | 1 |
| | | 00–10 Minute Only | 20–30 Minute Only | 30–50 Minute Only |

Table 1–3

| Time | BCD Parallel Signal for Hour DCBA | 12–3 a | b | c |
|---|---|---|---|---|
| 0 Hour | 0000 | 0 | 0 | 0 |
| 1 Hour | 0001 | 1 | 1 | 0 |
| 2 Hour | 0010 | 0 | 1 | 0 |
| 3 Hour | 0011 | 1 | 1 | 0 |
| 4 Hour | 0100 | 0 | 0 | 0 |
| 5 Hour | 0101 | 1 | 0 | 0 |
| 6 Hour | 0110 | 0 | 0 | 1 |
| 7 Hour | 0111 | 1 | 1 | 1 |
| 8 Hour | 1000 | 0 | 1 | 1 |
| 9 Hour | 1001 | 1 | 1 | 1 |
| 10 Hour | 1010 | 0 | 0 | 1 |
| 11 Hour | 1011 | 1 | 0 | 1 |
| | | 1 Hour Interval | 3 Hour Interval | 5 Hour Interval |

Table 1–4

| Time | 12–4 Input | 12–4 Output | Time | 12–4 Input | 12–4 Output |
|---|---|---|---|---|---|
| 0 | 0 | 0 | 6 | 0 | 0 |
| 1 | 0 | 0 | 7 | 0 | 0 |
| 2 | 0 | 0 | 8 | 0 | 0 |
| 3 | 0 | 0 | 9 | 0 | 0 |
| 4 | 0 | 0 | 10 | 1 | 1 |

Table 1-4-continued

| Time | 12-4 Input | 12-4 Output | Time | 12-4 Input | 12-4 Output |
|---|---|---|---|---|---|
| 5 | 0 | 0 | 11 | 1 | 1 |

The pins not specifically explained are non-connected pins.

Figure 13:
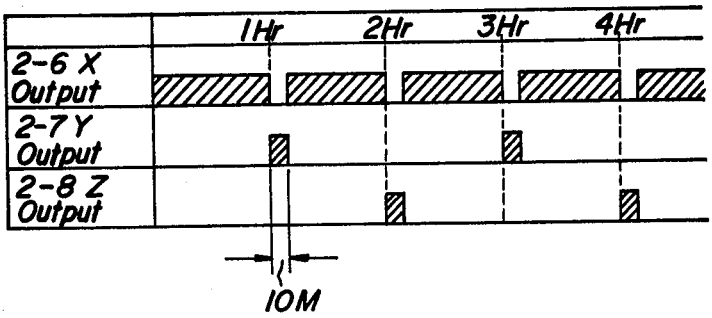
FIG. 13 is a signal time chart of a decoder.

Outputs XYZ of the decoders 12-9, 12-10, 12-11 are as shown in FIG. 13.

Output signal X of decoder 12-9 of FIG. 12 is fed to inhibit input terminals of inhibit gates **18-1-*a*1 to 18-1-*a*47 via 2 input OR gate 17-1 of FIG. 10 and interrupts time character signal of a time character decoder 14**, which will be explained later, for 10 minutes at each hour of 00 to 10 minute.

Output signal Y of decoder 12-10 of FIG. 12 is fed to inhibit input terminals of inhibit gates **18-2-*a*1 to 18-2-*a*47 of FIG. 10 via 2-input OR gate 17-2 and delivers a signal from a memory device 13-1**, which will be explained later, for 10 minutes of 00 to 10 minute at each odd hour such as 1 O'clock, 3 O'clock, 5 O'clock, etc.

Output signal Z of decoder 12-11 of FIG. 12 is fed to inhibit input terminals of inhibit gates **18-3-*a*1 to 18-3-*a*47 of FIG. 10 via 2-input OR gate 17-3 and delivers a signal from a memory device 13-2**, which will be explained later, for 10 minutes of 00 to 10 minute at each even hour such as 2 O'clock, 4 O'clock, 6 O'clock, etc.

Figure 14:
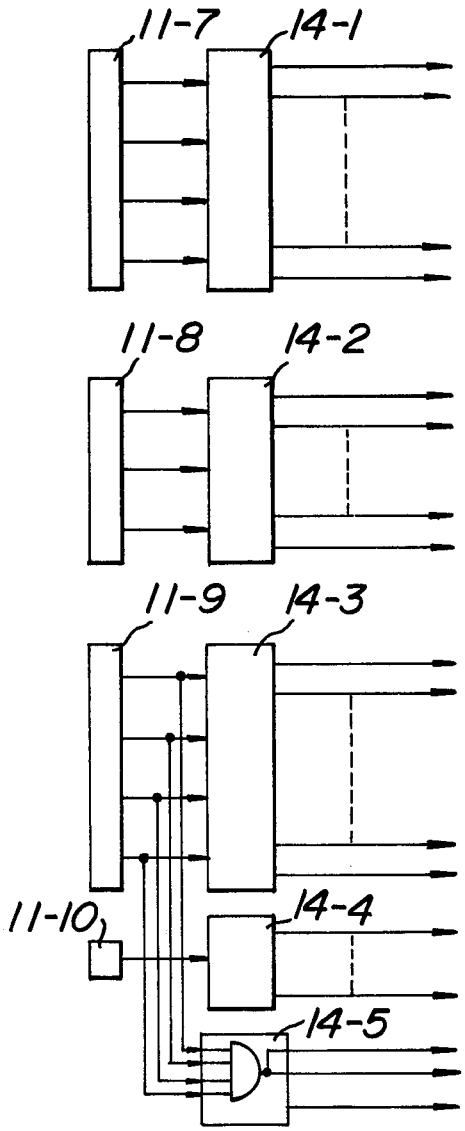
FIG. 14 is a detailed diagram of a clock character decoder.

FIG. 14 is a detailed block diagram of the time character decoder 14.

The BCD parallel signals sent through connectors 11-7, 11-8, 11-9, 11-10 are supplied to decoders 14-1, 14-2, 14-3, 14-4 and decoded therein. The BCD parallel signals at the connector 11-9 are also sent to 4-input OR gate 14-5.

Decoder 14-1 represents a minute unit, and it has 49 outputs corresponding to nozzles **7*a*-41 to 7*g*-47 shown in FIG. 8. Decoder 14-2 represents 10 minute intervals and it has 70 outputs corresponding to nozzles 7*a*-31 to 7*g*-40 in FIG. 8. Decoder 14-3 represents hours and it has 70 outputs corresponding to nozzles 7*a*-11 to 7*g*-20. Decoder 14-4 represents 10 hours and it has 70 outputs corresponding to nozzles 7*a*-1 to 7*g*-10**.

4-input OR gate 14-5 is to display the notation ":" and it has 70 outputs corresponding to nozzles **7*a*-21 to 7*g*-30 of the nozzle arrangement shown in FIG. 8. Inputs of nozzles 7*c*-24 and 7*e*-24 in FIG. 8 are connected to the outputs of the 4-input OR gate 14-5** and all other inputs of the above nozzles are connected to ground.

It will require a much too detailed explanation to show all of the true values for indicating the time display of 12 O'clock 34 minute as shown in FIG. 9A, so that only the input to output relation showing unit minute and 10 minute digits for indicating 34 minutes is shown in Table 2.

An electromagnetic valve controller 20 corresponding to logic valve "1" operates to energize electromagnetic valve groups **6*a*-6*g***.

This means that nozzles corresponding to logic value "1", i.e. nozzles **7*a*-45, 7*b*-45, 7*c*-41, 42, 43, 44, 45, 46, 47, 7*d*-41, 45, 7*e*-41, 45, 7*f*-41, 45, 7*g*-41, 45 display numeral "4" and nozzles 7*a*-31, 32, 33, 34, 35, 36, 37, 7*b*-37, 7*c*-37, 7*d*-31, 32, 33, 34, 35, 36, 37, 7*e*-37, 7*f*-37, 7*g*-31, 32, 33, 34, 35, 36, 37** display numeral "3" respectively.

Table 2-1a

| Minute Unit | 0 | 1 | 2 | 3 | 4 | 5 | 6 | 7 | 8 | 9 |
|---|---|---|---|---|---|---|---|---|---|---|
| BCD Parallel Signals | | | | | | | | | | |
| D | 0 | 0 | 0 | 0 | 0 | 0 | 0 | 0 | 1 | 1 |
| C | 0 | 0 | 0 | 0 | 1 | 1 | 1 | 1 | 0 | 0 |
| B | 0 | 0 | 1 | 1 | 0 | 0 | 1 | 1 | 0 | 0 |
| A | 0 | 1 | 0 | 1 | 0 | 1 | 0 | 1 | 0 | 1 |
| a41 | 1 | 0 | 1 | 1 | 0 | 1 | 1 | 0 | 1 | 0 |
| a42 | 1 | 0 | 1 | 1 | 0 | 1 | 1 | 0 | 1 | 0 |
| a43 | 1 | 0 | 1 | 1 | 0 | 1 | 1 | 0 | 1 | 0 |
| a44 | 1 | 1 | 1 | 1 | 0 | 1 | 1 | 1 | 1 | 0 |
| a45 | 1 | 0 | 1 | 1 | 1 | 1 | 1 | 0 | 1 | 0 |
| a46 | 1 | 0 | 1 | 1 | 0 | 1 | 1 | 0 | 1 | 0 |
| a47 | 1 | 0 | 1 | 1 | 0 | 1 | 1 | 0 | 1 | 1 |
| b41 | 1 | 0 | 1 | 0 | 0 | 0 | 1 | 0 | 1 | 0 |
| b42 | 0 | 0 | 0 | 0 | 0 | 0 | 0 | 0 | 0 | 0 |
| b43 | 0 | 0 | 0 | 0 | 0 | 0 | 0 | 0 | 0 | 0 |
| b44 | 0 | 1 | 0 | 0 | 0 | 0 | 0 | 1 | 0 | 0 |
| b45 | 0 | 0 | 0 | 0 | 1 | 0 | 0 | 0 | 0 | 0 |
| b46 | 0 | 0 | 0 | 0 | 0 | 0 | 0 | 0 | 0 | 0 |
| b47 | 1 | 0 | 0 | 1 | 0 | 1 | 1 | 0 | 1 | 1 |
| c41 | 1 | 0 | 1 | 0 | 1 | 0 | 1 | 0 | 1 | 0 |
| c42 | 0 | 0 | 0 | 0 | 1 | 0 | 0 | 0 | 0 | 0 |
| c43 | 0 | 0 | 0 | 0 | 1 | 0 | 0 | 0 | 0 | 0 |
| c44 | 0 | 1 | 0 | 0 | 1 | 0 | 0 | 0 | 0 | 0 |
| c45 | 0 | 0 | 0 | 0 | 1 | 0 | 0 | 1 | 0 | 0 |
| c46 | 0 | 0 | 0 | 0 | 1 | 0 | 0 | 0 | 0 | 0 |
| c47 | 1 | 0 | 0 | 1 | 1 | 1 | 1 | 0 | 1 | 1 |
| d41 | 1 | 0 | 1 | 1 | 1 | 1 | 1 | 0 | 1 | 1 |
| d42 | 0 | 0 | 1 | 1 | 0 | 1 | 1 | 0 | 1 | 1 |
| d43 | 0 | 0 | 1 | 1 | 0 | 1 | 1 | 0 | 1 | 1 |
| d44 | 0 | 1 | 1 | 1 | 0 | 1 | 1 | 0 | 1 | 1 |
| d45 | 0 | 0 | 1 | 1 | 1 | 1 | 1 | 0 | 1 | 1 |
| d46 | 0 | 0 | 1 | 1 | 0 | 1 | 1 | 1 | 1 | 1 |
| d47 | 1 | 0 | 1 | 1 | 0 | 1 | 1 | 0 | 1 | 1 |

Table 2-1b

| Minute Unit | 0 | 1 | 2 | 3 | 4 | 5 | 6 | 7 | 8 | 9 |
|---|---|---|---|---|---|---|---|---|---|---|
| BCD Parallel Signals | | | | | | | | | | |
| D | 0 | 0 | 0 | 0 | 0 | 0 | 0 | 0 | 1 | 1 |
| C | 0 | 0 | 0 | 0 | 1 | 1 | 1 | 1 | 0 | 0 |
| B | 0 | 0 | 1 | 1 | 0 | 0 | 1 | 1 | 0 | 0 |
| A | 0 | 1 | 0 | 1 | 0 | 1 | 0 | 1 | 0 | 1 |
| e41 | 1 | 0 | 0 | 0 | 1 | 1 | 1 | 0 | 1 | 1 |
| e42 | 0 | 0 | 0 | 0 | 0 | 0 | 0 | 0 | 0 | 0 |
| e43 | 0 | 0 | 0 | 0 | 0 | 0 | 0 | 0 | 0 | 0 |
| e44 | 0 | 1 | 0 | 0 | 0 | 0 | 0 | 0 | 0 | 0 |
| e45 | 0 | 0 | 0 | 0 | 1 | 0 | 0 | 0 | 0 | 0 |
| e46 | 0 | 0 | 0 | 0 | 0 | 0 | 0 | 0 | 0 | 0 |
| e47 | 1 | 0 | 1 | 1 | 0 | 0 | 0 | 1 | 1 | 1 |
| f41 | 1 | 0 | 0 | 0 | 1 | 1 | 1 | 1 | 1 | 1 |
| f42 | 0 | 0 | 0 | 0 | 0 | 0 | 0 | 0 | 0 | 0 |
| f43 | 0 | 0 | 0 | 0 | 0 | 0 | 0 | 0 | 0 | 0 |
| f44 | 0 | 1 | 0 | 0 | 0 | 0 | 0 | 0 | 0 | 0 |
| f45 | 0 | 0 | 0 | 0 | 1 | 0 | 0 | 0 | 0 | 0 |
| f46 | 0 | 0 | 0 | 0 | 0 | 0 | 0 | 0 | 0 | 0 |
| f47 | 1 | 0 | 1 | 1 | 0 | 0 | 0 | 1 | 1 | 1 |
| g41 | 1 | 0 | 1 | 1 | 1 | 1 | 1 | 1 | 1 | 1 |
| g42 | 1 | 0 | 1 | 1 | 0 | 1 | 1 | 1 | 1 | 1 |
| g43 | 1 | 0 | 1 | 1 | 0 | 1 | 1 | 1 | 1 | 1 |
| g44 | 1 | 1 | 1 | 1 | 0 | 1 | 1 | 1 | 1 | 1 |
| g45 | 1 | 0 | 1 | 1 | 1 | 1 | 1 | 1 | 1 | 1 |
| g46 | 1 | 0 | 1 | 1 | 0 | 1 | 1 | 1 | 1 | 1 |
| g47 | 1 | 0 | 1 | 1 | 0 | 1 | 1 | 1 | 1 | 1 |

Table 2-2a

| 10 Minute Unit | 0 | 10 | 20 | 30 | 40 | 50 |
|---|---|---|---|---|---|---|
| BCD Parallel Signals | | | | | | |
| D | 0 | 0 | 0 | 0 | 0 | 0 |
| C | 0 | 0 | 0 | 0 | 1 | 1 |
| B | 0 | 0 | 1 | 1 | 0 | 0 |
| A | 0 | 1 | 0 | 1 | 0 | 1 |
| a31 | 1 | 0 | 1 | 1 | 0 | 1 |
| a32 | 1 | 0 | 1 | 1 | 0 | 1 |
| a33 | 1 | 0 | 1 | 1 | 0 | 1 |
| a34 | 1 | 1 | 1 | 1 | 0 | 1 |
| a35 | 1 | 0 | 1 | 1 | 1 | 1 |
| a36 | 1 | 0 | 1 | 1 | 0 | 1 |
| a37 | 1 | 0 | 1 | 1 | 0 | 1 |
| a38 | 0 | 0 | 0 | 0 | 0 | 0 |
| a39 | 0 | 0 | 0 | 0 | 0 | 0 |
| a40 | 0 | 0 | 0 | 0 | 0 | 0 |

Table 2-2a-continued

| 10 Minute Unit | 0 | 10 | 20 | 30 | 40 | 50 |
|---|---|---|---|---|---|---|
| BCD Parallel Signals | | | | | | |
| D | 0 | 0 | 0 | 0 | 0 | 0 |
| C | 0 | 0 | 0 | 0 | 1 | 1 |
| B | 0 | 0 | 1 | 1 | 0 | 0 |
| A | 0 | 1 | 0 | 1 | 0 | 1 |
| b31 | 1 | 0 | 1 | 0 | 0 | 0 |
| b32 | 0 | 0 | 0 | 0 | 0 | 0 |
| b33 | 0 | 0 | 0 | 0 | 0 | 0 |
| b34 | 0 | 1 | 0 | 0 | 0 | 0 |
| b35 | 0 | 0 | 0 | 0 | 1 | 0 |
| b36 | 0 | 0 | 0 | 0 | 0 | 0 |
| b37 | 1 | 0 | 0 | 1 | 0 | 1 |
| b38 | 0 | 0 | 0 | 0 | 0 | 0 |
| b39 | 0 | 0 | 0 | 0 | 0 | 0 |
| b40 | 0 | 0 | 0 | 0 | 0 | 0 |
| c31 | 1 | 0 | 1 | 0 | 1 | 0 |
| c32 | 0 | 0 | 0 | 0 | 1 | 0 |
| c33 | 0 | 0 | 0 | 0 | 1 | 0 |
| c34 | 0 | 1 | 0 | 0 | 1 | 0 |
| c35 | 0 | 0 | 0 | 0 | 1 | 0 |
| c36 | 0 | 0 | 0 | 0 | 1 | 0 |
| c37 | 1 | 0 | 0 | 1 | 1 | 1 |
| c38 | 0 | 0 | 0 | 0 | 0 | 0 |
| c39 | 0 | 0 | 0 | 0 | 0 | 0 |
| c40 | 0 | 0 | 0 | 0 | 0 | 0 |

Table 2-2b

| 10 Minute Unit | 0 | 10 | 20 | 30 | 40 | 50 |
|---|---|---|---|---|---|---|
| BCD Parallel Signals | | | | | | |
| D | 0 | 0 | 0 | 0 | 0 | 0 |
| C | 0 | 0 | 0 | 0 | 1 | 1 |
| B | 0 | 0 | 1 | 1 | 0 | 0 |
| A | 0 | 1 | 0 | 1 | 0 | 1 |
| d31 | 1 | 0 | 1 | 1 | 1 | 1 |
| d32 | 0 | 0 | 1 | 1 | 0 | 1 |
| d33 | 0 | 0 | 1 | 1 | 0 | 1 |
| d34 | 0 | 1 | 1 | 1 | 0 | 1 |
| d35 | 0 | 0 | 1 | 1 | 1 | 1 |
| d36 | 0 | 0 | 1 | 1 | 0 | 1 |
| d37 | 1 | 0 | 1 | 1 | 0 | 1 |
| d38 | 0 | 0 | 0 | 0 | 0 | 0 |
| d39 | 0 | 0 | 0 | 0 | 0 | 0 |
| d40 | 0 | 0 | 0 | 0 | 0 | 0 |
| f31 | 1 | 0 | 0 | 0 | 1 | 1 |
| f32 | 0 | 0 | 0 | 0 | 0 | 0 |
| f33 | 0 | 0 | 0 | 0 | 0 | 0 |
| f34 | 0 | 1 | 0 | 0 | 0 | 0 |
| f35 | 0 | 0 | 0 | 0 | 1 | 0 |
| f36 | 0 | 0 | 0 | 0 | 0 | 0 |
| f37 | 1 | 0 | 1 | 1 | 0 | 0 |
| f38 | 0 | 0 | 0 | 0 | 0 | 0 |
| f39 | 0 | 0 | 0 | 0 | 0 | 0 |
| f40 | 0 | 0 | 0 | 0 | 0 | 0 |
| g31 | 1 | 0 | 1 | 1 | 1 | 1 |
| g32 | 1 | 0 | 1 | 1 | 0 | 1 |
| g33 | 1 | 0 | 1 | 1 | 0 | 1 |
| g34 | 1 | 1 | 1 | 1 | 0 | 1 |
| g35 | 1 | 0 | 1 | 1 | 1 | 1 |
| g36 | 1 | 0 | 1 | 1 | 0 | 1 |
| g37 | 1 | 0 | 1 | 1 | 0 | 1 |
| g38 | 0 | 0 | 0 | 0 | 0 | 0 |
| g39 | 0 | 0 | 0 | 0 | 0 | 0 |
| g40 | 0 | 0 | 0 | 0 | 0 | 0 |

Figure 15A:
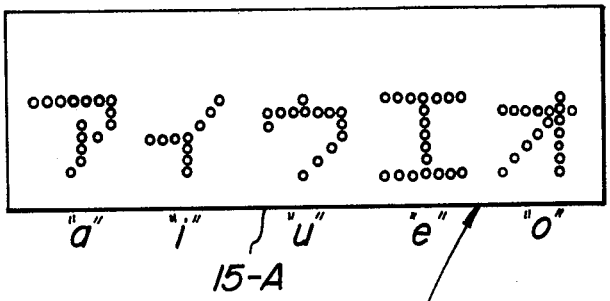
FIGS. 15A and 15B are one embodiment of punched card and a practical diagram of a memory device.
Figure 15B:
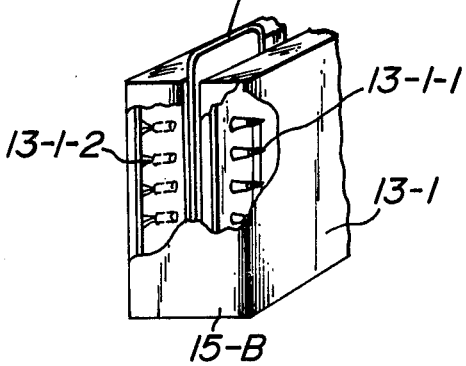

FIGS. 15A and 15B show one practical embodiment of the memory 13-1.

Figure 16:
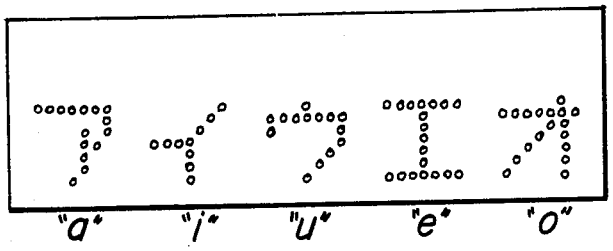
FIG. 16 is a detailed view of a coin timer and a manual display device shown in FIG. 10.
Figure 16:
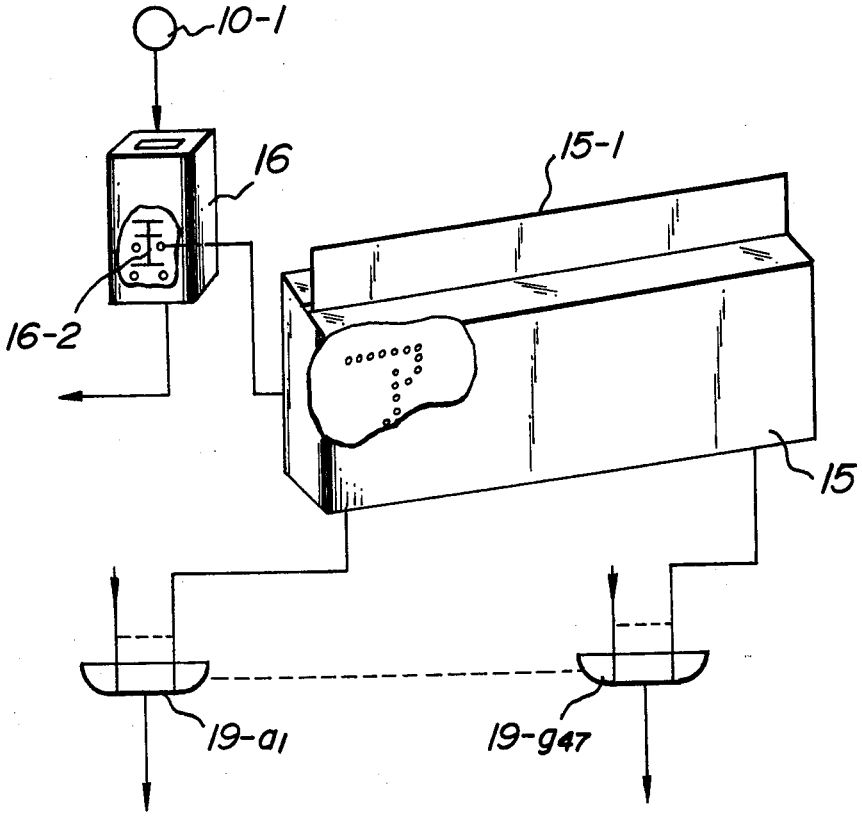

The memory comprises a punched card shown in FIG. 15-A and an optical card reader shown in FIG. 16-B. The memory produces a signal representing characters, notations, etc. and controls the electromagnetic valve controller 20 via the 2-input OR gates 17-2, 17-3 and the inhibit gates (**18-2-*a*1 to 18-2-*g*47) (18-3-*a*1 to 18-3-*g*47) so as to operate the necessary electromagnetic valves to produce the display from valves 6*a* to 6*g*** and their corresponding nozzles.

When the Japanese characters "*a, i, u, e, o*" shown in FIG. 9-B is to be displayed, the punched card shown in FIG. 15-A is punched at corresponding location of the nozzle arrangement shown in FIG. 8, for instance, at **7*a*-3, 7*b*-4, 7*c*-4, 7*d*-4, 6, 7*e*-4, 7, 7*f*-7, 7*g*-1, 2, 3, 4, 5, 6, 7** for "*a*" and **7*a*-14, 7*b*-14, 7*c*-14, 7*d*-11, 12, 13, 14, 7*e*-15, 7*f*-16, 7*g*-17** for "*i*" and so on for "*u*", "*e*", "*o*".

By inserting the punched card into an optical card reader 15-B, a group of photodiodes 13-1-1 of the same number with the nozzles irradiates light and the light passes through the punched portion and oppositely arranged phototransistors 13-1-2 are energized and converted electric signal is obtained.

The electric signal is sent to electromagnetic valve controller 20 via the 4-input OR gates **19-*a*1 to 19-*g*47 only for a time between 00 to 10 minute only at each odd hour of 1, 3, 5 O'clock and the respective electromagnetic valve groups 6*a* to 6*g*** are energized to discharge water jets from the corresponding nozzles.

Memory 13-2 functions in the same manner with the memory 13-1.

FIG. 16 is a more detailed view for showing the coin timer 16 and the manual display device 15.

When a coin 16-1 is dropped in the coin timer 16, a switch 16-2 installed in the coin timer 16 closes and a priority signal is sent to the manual display device for a predetermined duration. The manual display device starts its operation and its signal will close all the gates of the inhibit gates (**18-1-*a*1 to 18-1-*g*47) (18-2-*a*1 to 18-2-i *g*47) (18-3-*a*1 to 18-3-*g*47) through 2-input OR gates 17-1, 17-2, 17-3. In the manual display device 15, a card 15-1 is given some indication, such as, characters or notations and punched at positions corresponding to nozzle arrangement shown in FIG. 8** and it is inserted into the manual display device.

Construction of the manual display device 15 is nearly same as the optical card reader as shown in FIG. 15, and the indicated characters or notations to be displayed are converted into an electric signal by means of photo-diodes and photo-transistors provided in the same number of the nozzles.

This electric signal is used through 4-input OR gates 19-i a1 to **19-*g*47 shown in FIG. 10 to energize electromagnetic valve controller 20, and is eventually used to display by fountain in the same manner as punched by operating electromagnetic valve groups 6*a* to 6*g*.**

In this embodiment, an optical card reader has been used for the memories 13-1 and 13-2 and the manual display device 15, however, a memory device using a magnetic tape, a magnetic disc, an optical tape, a core memory, a semiconductor memory, a laser memory or the like can be used.

A phototransistor has been used for an element delivering a signal when illuminated, however, photosensitive element such as a *cds,* selenium cell, photo-electric tube can be used for obtaining the same effect.

Figure 17A:
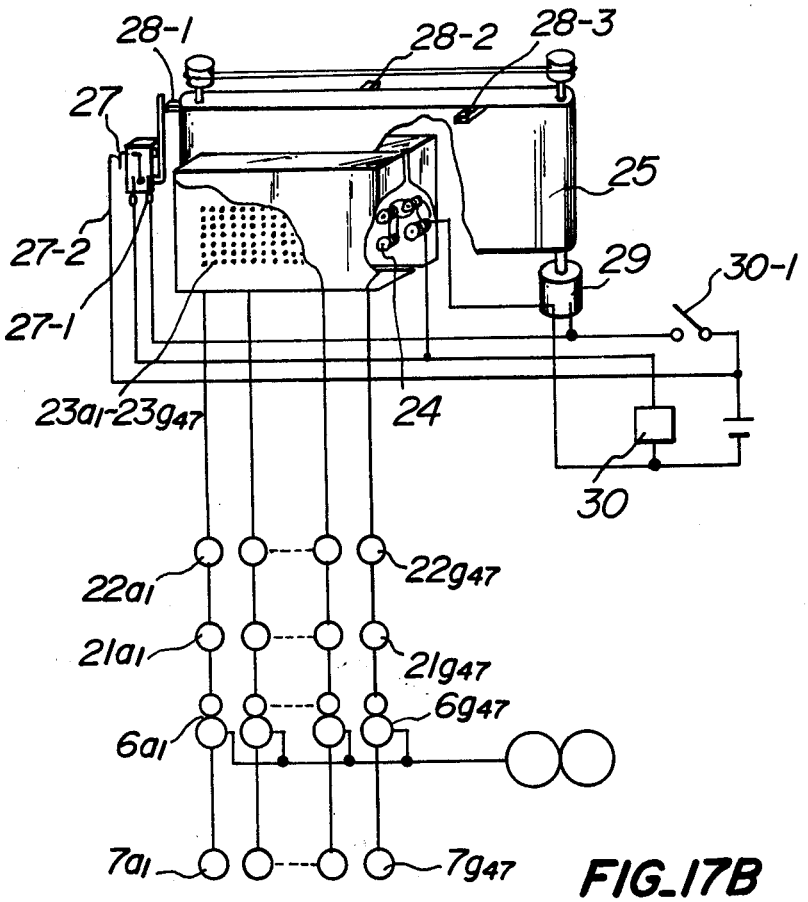
FIGS. 17A and 17B show diagram of an alternative embodiment of the valve control circuit shown in FIG. 10 and one embodiment of display.
Figure 17B:
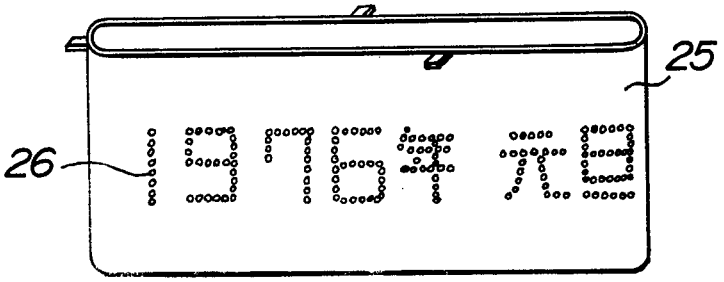

FIGS. 17A and 17B show another embodiment of the valve control circuit shown in FIG. 10.

The embodiment shows in more detail for displaying 3 kinds of displays of the characters "1976 year (Chinese character)", "new year (Chinese character)" and "happy (Japanese character "OMEDETOU")" by using 329 nozzles and electromagnetic valves one for each nozzle.

Nozzles **7*a*-1 to 7*g*-47 are controlled by electromagnetic valves 6*a*1 to 6*g*47. The electromagnetic valves 6*a*1 to 6*g*47 are controlled by electromagnetic valve controllers 21*a*1 to 21*g*47 and the controllers are regulated by photo-signal amplifiers 22*a*1 to 22*g*47**.

The group of photo-signal amplifiers are operated by phototransistor group **23*a*1 to 23*g*47. Lamp group 24 emanates light and it passes through punched hole 26 of the tape 25 and illuminated phototransistor groups 23*a*1 to 23*g*47** deliver output signal.

Figure 18:
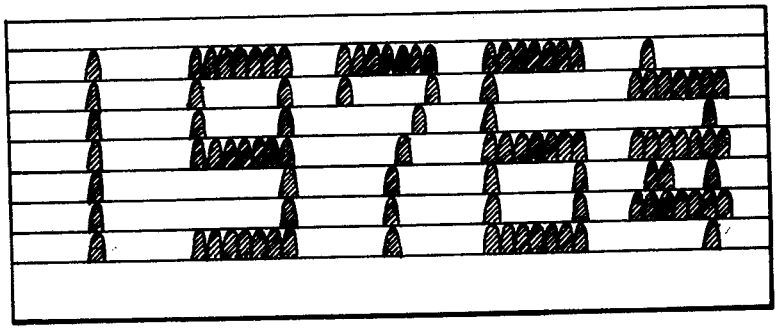
FIGS. 18 to 20 are various examples of display in front views.
Figure 19:
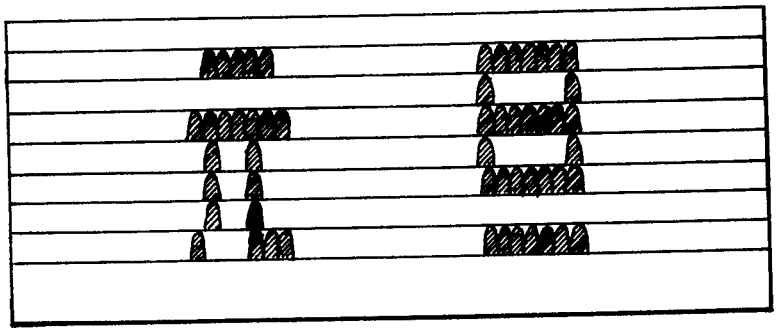
Figure 20:
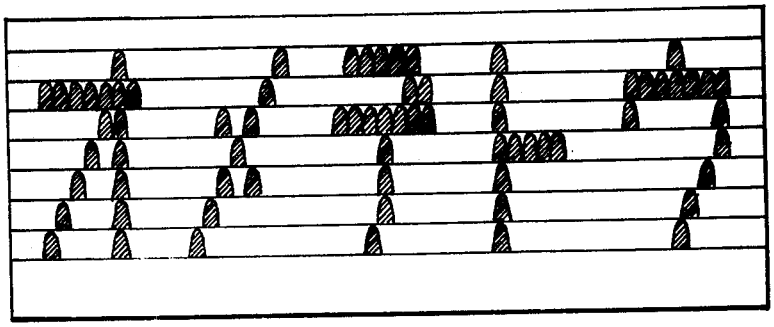

The tape 25 has been punched separately the desired 3 kinds of display of the characters "1976 year," "new year," "happy" as shown in FIGS. 18, 19 and 20 at corresponding location of the nozzles.

In case of characters "1976 year," the tape 25 is punched at corresponding locations for 6*a*4, 6*b*4, 6*c*4, 6*d*4, 6*e*4, 6*f*4, 6*g*4 for "1"; 6*a*11 to 6*a*17, 6*b*17, 6*c*17, 6*d*11 to 6*d*17, 6*e*11, 6*e*17, 6*f*11, 6*f*17, 6*g*11 to 6*g*17 for "9"; 6*a*24, 6*b*24, 6*c*24, 6*d*25, 6*e*26, 6*f*21, 6*f*27, 6*g*21 to 6*g*27 for "7"; 6*a*31 to 6*a*37, 6*b*31, 6*b*37, 6*c*31, 6*c*37, 6*d*31 to 6*d*37, 6*e*31, 6*f*31, 6*g*31 to 6*g*37 for "6"; 6*a*46, 6*b*41 to 6*b*47, 6*c*42, 6*c*43, 6*c*46, 6*d*41 to 6*d*47, 6*e*46, 6*f*41 to 6*f*47, 6*g*42 for "year"; 6*a*11, 6*a*15 to 6*a*17, 6*b*12, 6*b*15, 6*c*12, 6*c*15, 6*c*12, 6*c*15, 6*d*12, 6*d*15, 6*e*11 to 6*e*17, 6*g*12 to 6*g*16 for "new" and 6*a*31 to 6*a*37, 6*c*31 to 6*c*37, 6*d*31, 6*d*37, 6*e*31 to 6*e*37, 6*f*31, 6*f*37, 6*g*31 to 6*g*37 for "year" in case of displaying "new year" in Chinese character, and for displaying "OMEDETOU" in Japanese character, 6*a*1, 6*a*6, 6*b*2, 6*b*6, 6*c*3, 6*c*6, 6*d*4, 6*d*6, 6*e*5, 6*e*6, 6*f*1 to 6*f*7, 6*g*6 for "O", 6*a*11, 6*b*12, 6*c*13, 6*c*15, 6*b*14, 6*e*13, 6*e*15, 6*f*16, 6*g*17 for "ME," 6*a*23, 6*b*24, 6*c*24, 6*d*24, 6*e*21 to 6*e*27, 6*f*26, 6*f*27, 6*g*22 to 6*g*26 for "DE", 6*a*32, 6*b*32, 6*c*32, 6*d*32 to 6*d*37, 6*e*32, 6*f*32, 6*g*32 for "TO", and 6*a*43, 6*b*44, 6*c*45, 6*d*46, 6*e*41, 6*e*47, 6*f*41 to 6*f*47, 6*g*47 for "U". The tape 25 is made as endless and is provided with notches 28-1, 28-2, 28-3 for operating switch 27.

When holes 26 are aligned with phototransistors 23*a*1 to 23*g*47, the notch 28-1 opens the brake contact 27-1 of the switch 27 and deenergizes motor 29 so that tape 25 stops at the position. At the same time, a make contact 27-2 of the switch 27 completes or makes a circuit energizing lamp 24 and starting a timer 30.

When previously arranged setting time for display comes, a make contact 30-1 of the timer 30 closes, motor 29 is actuated and the tape 25 is driven to circulate again.

According to the rotary drive of the motor 29, the timer 30 releases due to release of the switch contact of the switch 27 and the lamp 24 is also turned off. At the same time, the motor 29 rotates only through brake contact 27-1 of the switch 27 and the punched tape 25 is driven by its rotation.

The same operation is repeated continuously.

Further embodiment for the display of characters or notations only will be explained.

Figure 21:
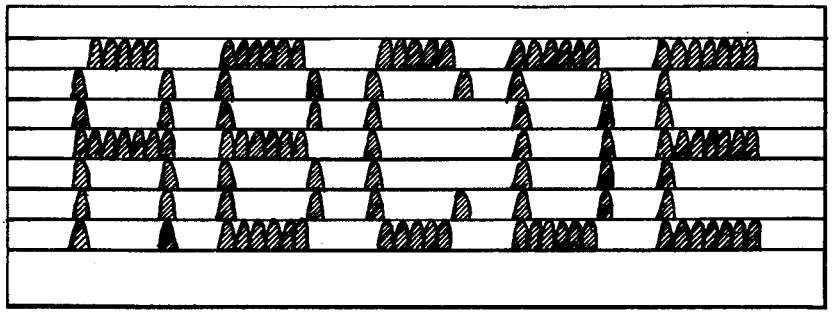
FIG. 21 is another embodiment of display showing characters in front view.
Figure 22:
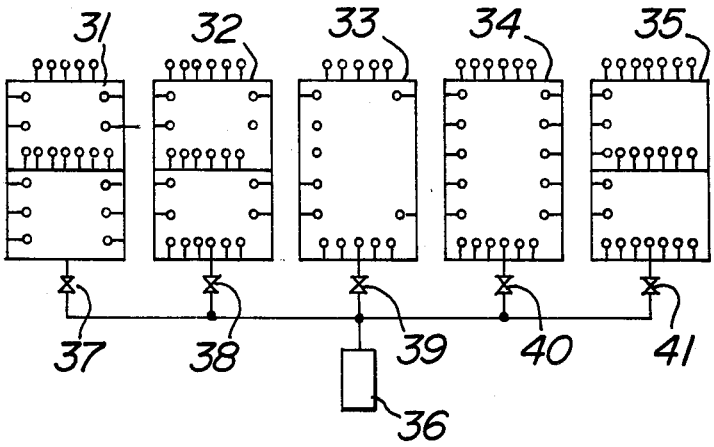
FIG. 22 is a diagram showing electromagnetic valves and tube arrangement for a device used in the display shown in FIG. 21.

In order to indicate characters "ABCDE" as shown in the front view of FIG. 21, the necessary nozzles and electromagnetic valves are arranged as shown in the tube trunk diagram of FIG. 22.

Figure 23:
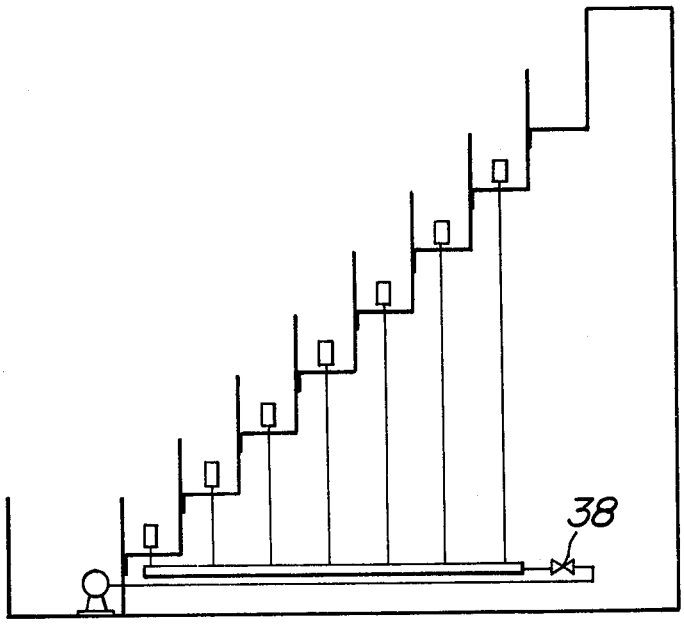
FIG. 23 is a side elevation of the display shown in FIG. 21.
Figure 24:
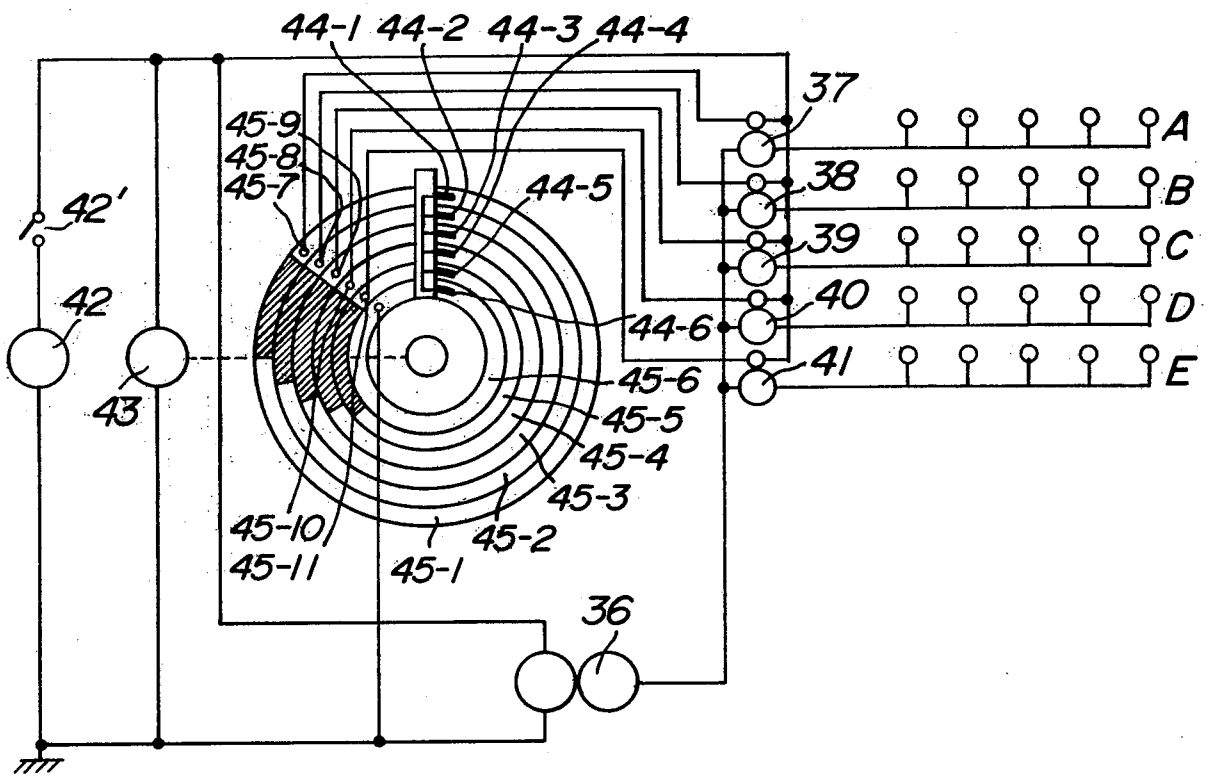
FIG. 24 is a circuit diagram of an electric valve control circuit used for the device shown in FIG. 22.

Cross-sectional view thereof is shown in FIG. 23 and a control circuit is shown in FIG. 24.

In the tube trunk diagram of FIG. 22, nozzles and electromagnetic valves 37, 38, 39, 40, 41 are arranged to display the characters ABCDE shown in the front view of FIG. 21 in a sequence of A→AB→ABC→ABCD→ABCDE. In this case, electromagnetic valve 37 controls nozzle group 31 for the character A, valve 38 controls nozzle group 32 for the character B, valve 39 controls nozzle group 33 for the character C, valve 40 controls nozzle group 34 for the character D, valve 41 controls nozzle group 35 for the character E.

Referring to the circuit diagram of FIG. 24, by closing the switch 42 the source 42 is coupled to the circuit to energize the motor pump 36 and the motor 43 is also energized.

By the operation of the motor pump 36, the electromagnetic valves 37, 38, 39, 40, 41 are fed with water pressure. At the same time the motor 43 drives to rotate blades 44-1, 44-2, 44-3, 44-4, 44-5, 44-6 and these blades moves slipping on respective copper foils 45-1, 45-2, 45-3, 45-4, 45-5, 45-6.

The blades 44-1, 44-2, 44-3, 44-4, 44-5, 44-6 are connected electrically.

These blades are connected earth side of the source 42 so that from the longest arc shaped copper foil 45-1 to the successive foils 45-2, 45-3, 45-4, 45-5, the foils are fed power and thus the electromagnetic valves 37, 38, 39, 40, 41 are energized in turn via foil connecting terminals 45-7, 45-8, 45-9, 45-10, 45-11.

By the successive operation of the electromagnetic valves 37, 38, 39, 40, 41 the corresponding groups of nozzles make correspondingly display A, AB, ABC, ABCD and ABCDE in turn.

A further embodiment of the present invention will be explained by referring to the front views of FIGS. 25 and 26, tube trunk diagram of FIG. 27, cross-sectional view of FIG. 28 and to the circuit diagram of FIG. 29.

Figure 25:
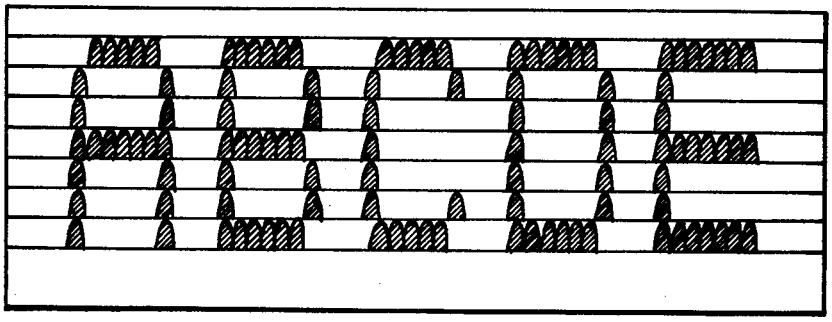
FIGS. 25 and 26 are further embodiments of display device according to the present invention in front views.
Figure 26:
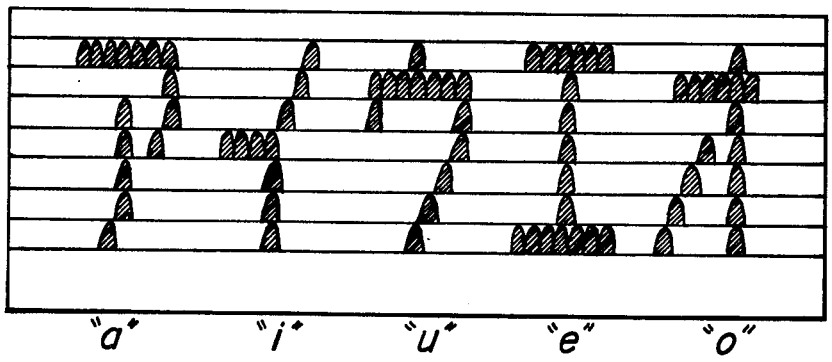

In this embodiment, characters "ABCDE" shown in FIG. 25 and characters "aiueo" shown in FIG. 26 are displayed in a sequence of A→AB→ABC→ABCD→ABCDE→a→ai→aiu→aiue→aiueo→A→AB.

The explanation is as follows.

Figure 29:
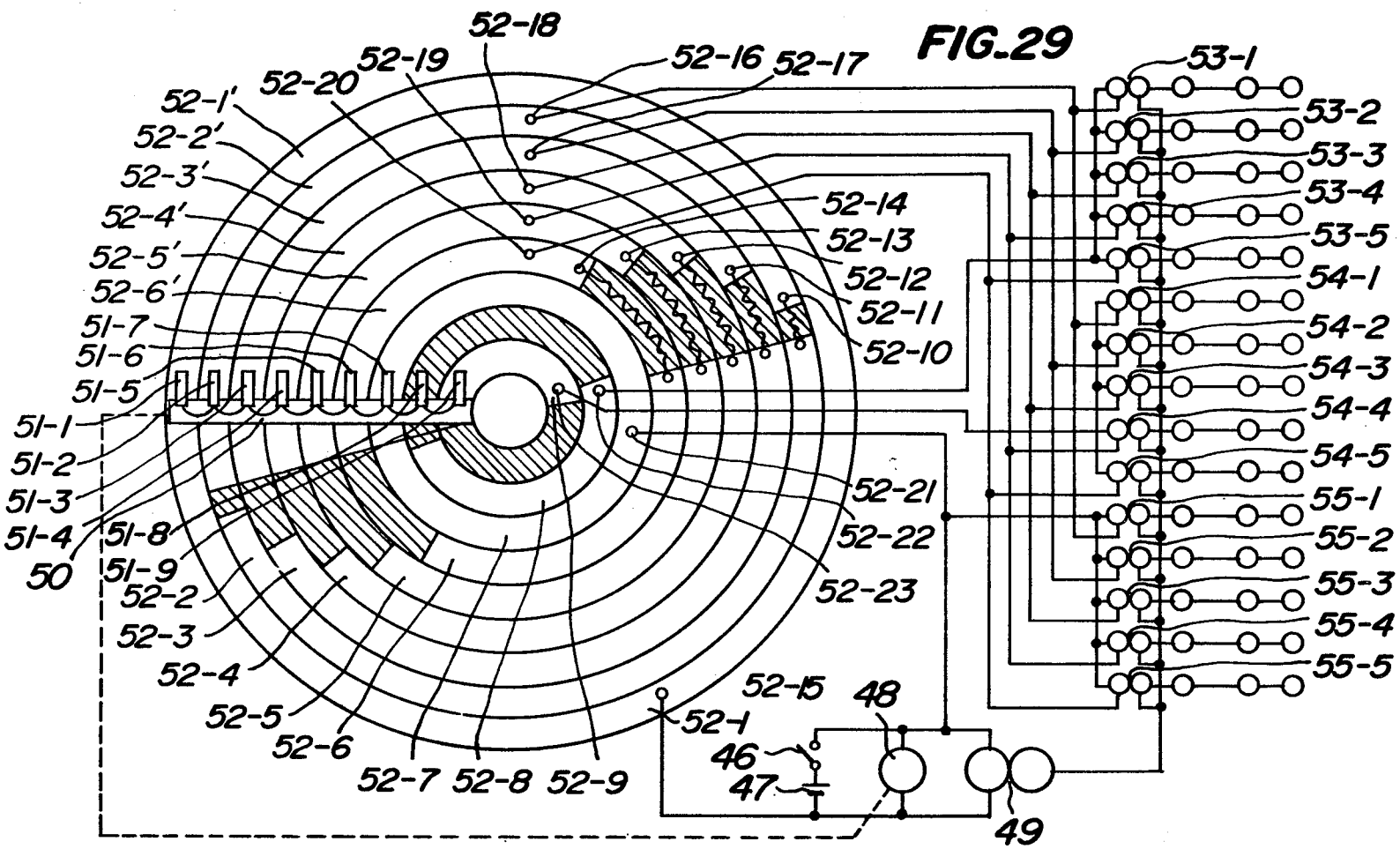
FIG. 29 is a diagram of a control circuit for electric valves shown in FIG. 27.

By closing a source switch 46 in FIG. 29, a geared motor 48 and a motor pump 49 are driven by the source 47.

By the rotation of the geared motor 48, blades 51-1 to 51-9 coupled to the axis rotate with the supporting plate 50 and the blades 51-1 to 51-9 slide on the copper foils 52-1 to 52-9.

The blades 51-1 to 51-6 are connected electrically. As the blade 51-1 slides on copper foil 52-1 and it couples negative side of the source 47 via a copper foil connecting terminal 52-15, the blades 51-2 to 51-6 conduct the same negative side of the source to corresponding copper foils 52-2, 52-3, 52-4, 52-5, 52-6 in an order of the sequence having longer mechanical distance.

The copper foils 52-2 to 52-6 and 52-2' to 52-6' are made rotational symmetrical about the center of the circle and they are coupled through short circuit wires 52-10 to 52-14 so that the source is connected twice in each rotational cycle of the geared motor 48.

The electrically coupled blades 51-7, 51-8, 51-9 slide on respective copper foils 52-7, 52-8, 52-9. As a copper foil connecting terminal 52-21 is connected to positive side of the source 47, in the first half rotation of the blades a copper foil 52-8 is connected and in the second half rotation a copper foil 52-9 is connected.

Figure 27:
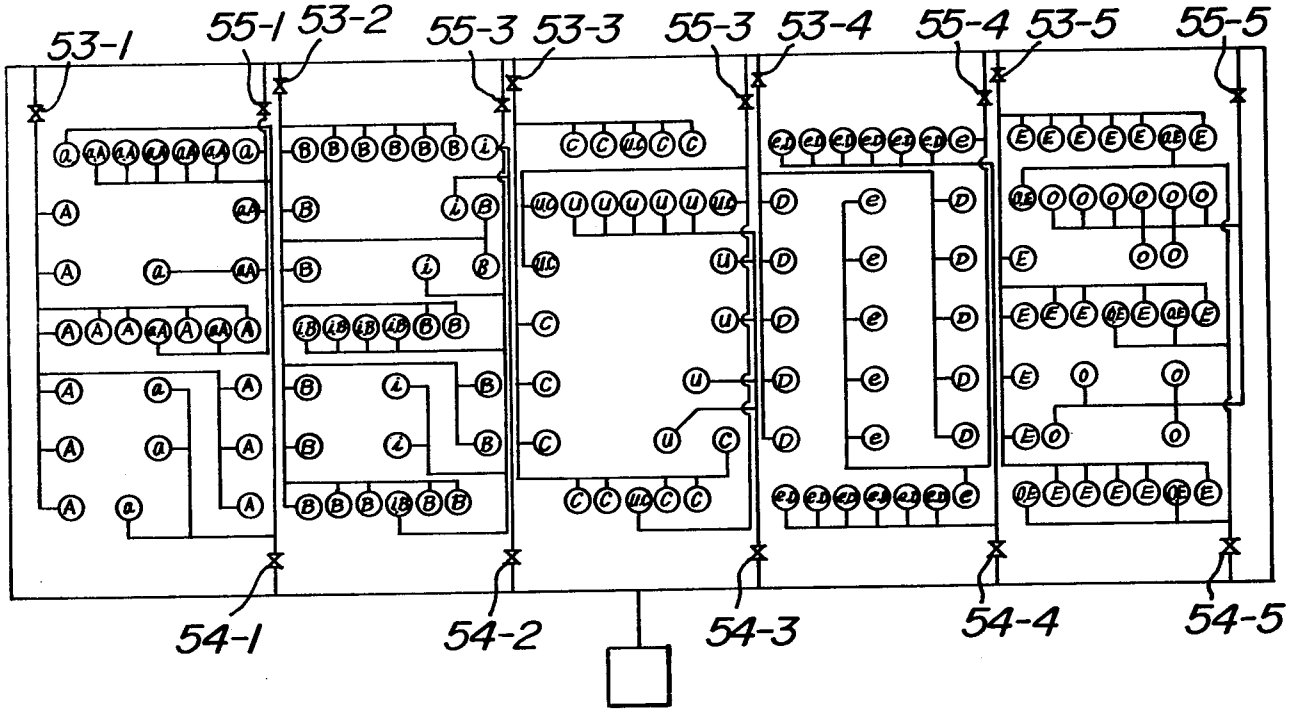
FIG. 27 is a diagram showing electromagnetic valves and tube arrangement for the devices of FIGS. 25 and 26.
Figure 28:
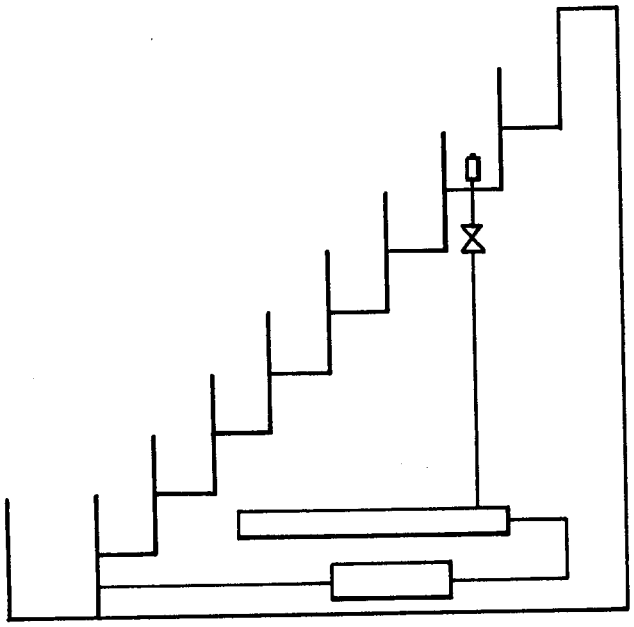
FIG. 28 is a side elevation of the devices of FIGS. 25 and 26.

The necessary nozzles for indicating characters "A" and "*a*", "B" and "*i*", "C" and "*u*", "D" and "*e*", "E" and "*o*" are arranged in the tube trunk diagram of FIG. 27. Electromagnetic valve 53-1 controls nozzles used exclusively for "A". Valve 54-1 controls nozzles used exclusively for "*a*". Valve 55-1 controls nozzles used commonly for "A" and "*a*".

In the same manner, valve 53-2 controls nozzles used exclusively for "B," valve 54-2 controls nozzles used exclusively for "*i*" and valve 55-2 controls nozzles used commonly for "B" and "*i*".

Also in a same manner, nozzles used only for "C" are controlled by valve 53-3, nozzles used only for "*u*" are controlled by valve 54-3, nozzles used both for "C" and "*u*" are controlled by valve 55-3.

Nozzles used only for the character "D" are coupled with valve 53-4, nozzles used only for "e" are coupled with valve 54-4, nozzles used both for "D" and "*e*" are coupled with valve 55-4.

Nozzles used only for the character "E" are coupled with valve 53-5, nozzles used only for "*o*" are coupled with valve 54-5, nozzles used commonly for "E" and "*o*" are coupled with valve 55-5.

The negative side of the thus connected valves 53-1, 54-1, 55-1 is connected to a connecting terminal 52-15. That of the valves 53-2, 54-2, 55-2 is connected to terminal 52-16, that of the valves 53-3, 54-3, 55-3 to terminal 52-17, that of the valves 53-4, 54-4, 55-4 to terminal 52-18 and that of the valves 53-5, 54-5, 55-5 to terminal 52-19 respectively.

Accordingly, a current flows from the copper foils 52-2 to 52-6 through blades 51-1 to 51-6 and foil 52-1 to the negative side of the source 47 and it becomes effective for the time corresponding to the length of the copper foils 52-2 to 52-6.

The positive side of the electromagnetic valves 53-1 to 53-5 is connected to a copper foil connecting terminal 52-22 so that it is connected to terminal 52-20 and to positive side of the source 47 through the foil 52-9, the blades 51-9, 51-7 and the copper foil 52-7.

Accordingly, it operates for a time corresponding to the length of the copper foil 52-9.

The positive side of the electromagnetic valves 54-1 to 54-5 is connected to connecting terminal 52-21 on the copper foil and to positive side of the source 47 through the foil 52-8, blades 51-8, 51-7, the foil 52-7 and the foil terminal 52-20.

Accordingly, the valves operate for a time corresponding to the length of the copper foil 52-8.

The positive side of the electromagnetic valves 55-1 to 55-5 is connected directly to the positive side of the source 47 so that the valves 55-1 to 55-5 operate for a time corresponding to length of the copper foils 52-2 to 52-6 and the operation is repeated twice in one rotation of the blade support plate 50.

By the operation of the electromagnetic valves 53-1 to 53-5 and 55-1 to 55-5, the characters ABCDE are displayed and by the operation of the electromagnetic valves 54-1 to 54-5 and 55-1 to 55-5, the characters aiueo are displayed.

Figure 30:
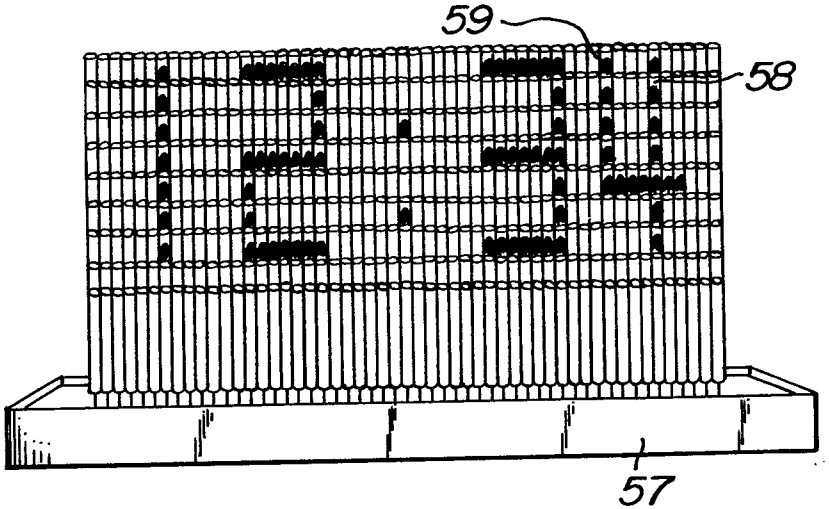
FIG. 30 is a front view of a pipe type fountain display device made in accordance with the present invention.

A more detailed explanation for an embodiment of the three dimensional fountain according to the present invention will be explained. FIG. 30 is a front view of one embodiment of a display device of the invention called a pipe system.

Figure 31:
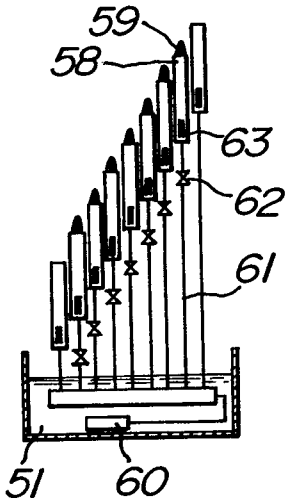
FIG. 31 is a side elevation of the device shown in FIG. 30.

FIG. 31 is a cross-sectional view of FIG. 30. As can be seen from FIG. 31, pipes 58 made of stainless steel, iron, or plastics are arranged in a series of steps above the water surface of a pond 57. By using a motor pump 60, water is fed to selected pipes 61 shown in FIG. 32 each such pipe being associated with a nozzle 63 housed in a pipe 58 and controlled by an electromagnetic valve 62 provided on the pipe 61. The display fountain can be activated as desired through the nozzles by operation of the respective valves 62.

Figure 32:
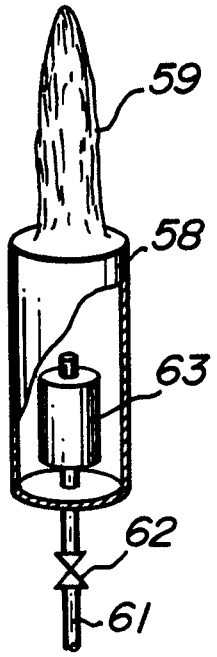
FIG. 32 is an enlarged view of a pipe.

FIG. 32 is an enlarged view showing a nozzle 63 housed in a pipe 58.

The pipe 58 may be any shape, such as circular, rectangular or ellipsoidal shape. This piping system has no need for a series of stepwise ponds but the pipes 58 may be provided in a number as may be required for the display.

FIG. 30 shows an embodiment using circular pipes which has a novel ornamental appearance.

In this pipe system, the water falls down along the outer surface of the pipe and accumulates in the pond 57. The water is circulated to the nozzles of the fountain by means of the pump 60.

For controlling the electromagnetic valves 62, a circuit such as shown in FIG. 10 can be used. This circuit can be applied equally for the other embodiments explained hereinafter.

Figure 33:
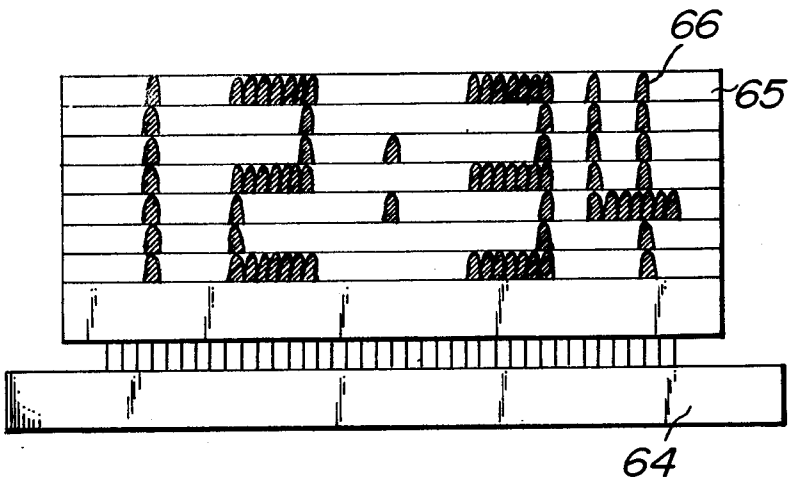
FIG. 33 is a front view of a box type fountain display device made in accordance with the present invention.

FIG. 33 is a front view of one embodiment of a box type fountain display according to the present invention.

Figure 34:
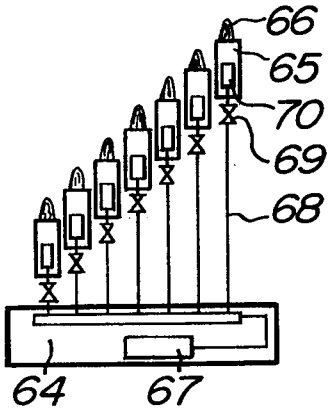
FIG. 34 is a side elevation of the device shown in FIG. 33.

FIG. 34 is a cross-sectional view of FIG. 33. As can be seen from FIG. 34, box shaped ponds 65 are arranged in a series of steps over a base pond 64. A motor pump 67 supplies water to tube 68 and the water is controlled by an electromagnetic valve 69 so as to discharge display fountain jets through nozzles 70.

Figure 35:
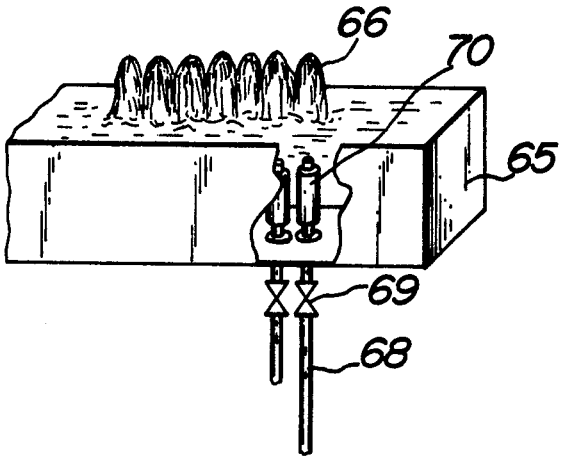
FIG. 35 is an enlarged view of a box.

FIG. 35 shows an enlarged view of the box 65 housing a nozzle 70.

According to this system, the water surface is always kept constant and the display jets 66 can be seen clearly so that the transparent separator plates **10*a* to 10*g* of FIG. 7** are not required.

Figure 36:
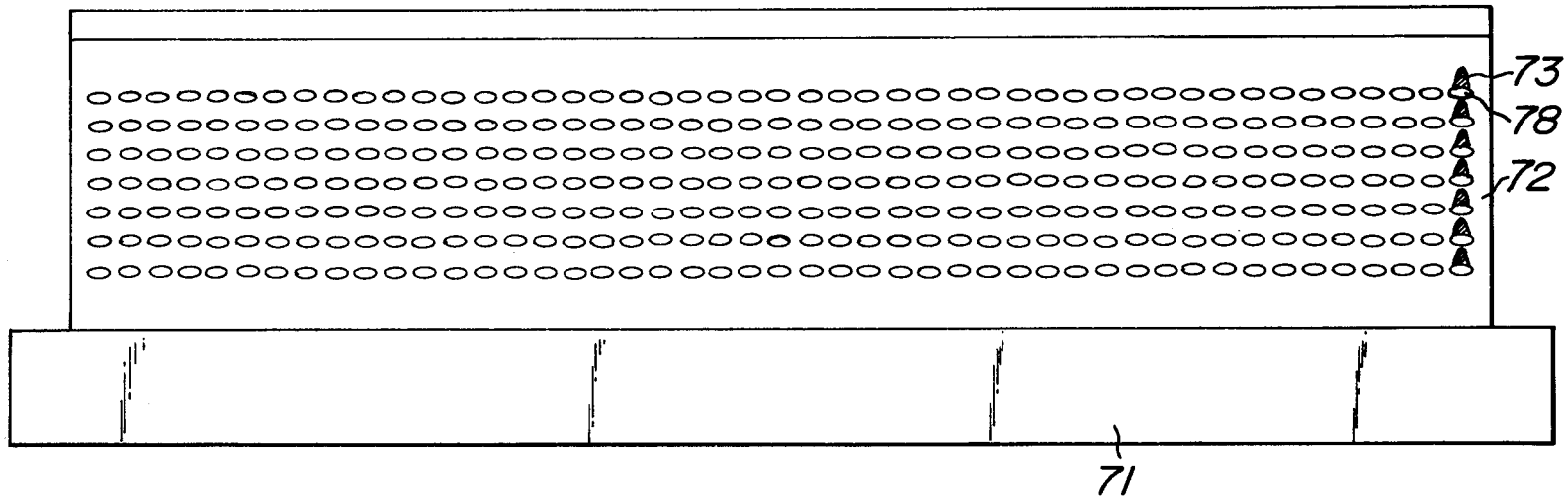
FIG. 36 is a front view of a fountain display device having a sloped plate.

FIG. 36 is a front view of one embodiment of a slope type fountain of the present invention.

Figure 37:
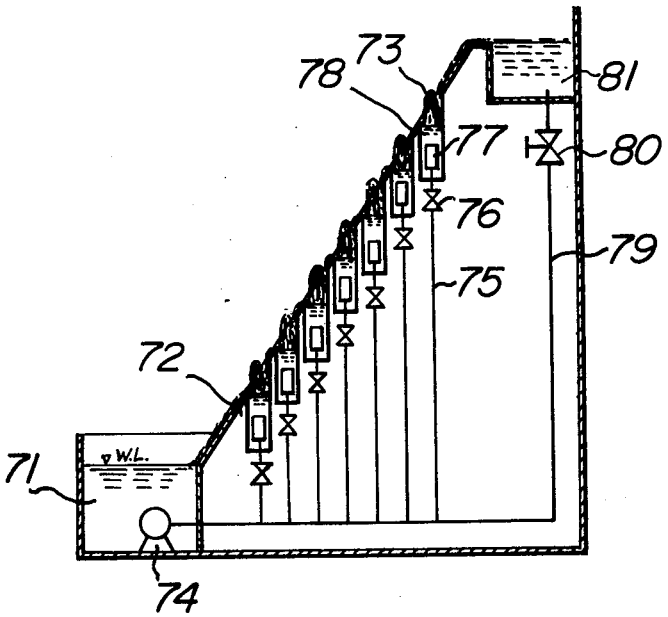
FIG. 37 is a side elevation of FIG. 36.

FIG. 37 is a cross-sectional view of FIG. 36. As can be seen from FIG. 36, a sloped plate 72 is provided over a base pond 71. The sloped plate 72 is provided with a number of jet holes 78. By using a motor pump 74, water is fed to a pipe 75 having an electromagnetic valve 76 and under its control water jet is ejected through a nozzle 77 to display a water spray 73.

The motor pump 74 also supplies water through pipe 79 to a water current header 81 from which water may be flowed down along the whole surface of the sloped plate 72.

The flow rate can be controlled by a manual valve 80 provided between the pipe 79 and the pit 81.

Although not indicated in the figures, the control panel of the display device may be separately installed and coupled with a cable. The control panel may also be provided in the body of the display device.

The invention is not limited for the above mentioned embodiments only, but any combination of the clock display with characters, and any combination of the characters may be possible which can be realized from the above mentioned examples.

For instance, any notation or trademark may also be displayed by the water fountain.

Straight water jets may be ejected around the device as accessories. Also the usual jet fountain may be displayed between various character displays.

A cascade fountain may be provided at step the portions by means of a by-pass jet nozzle from the top most portion of the device.

In the base pond, goldfishes or the like may be stocked.

It is obvious that a submerged pump may be used instead of an ordinary pump as explained.

In the FIGS. 31, 34 and 37, the regulating electromagnetic valve 8 and tank as shown in FIG. 7 have not been illustrated but it is obvious that these can be used therein.

The falling water from header 81 of FIG. 37 is for ornamental purpose of the sloped plate 72 so that it may be stopped whenever desired. Pipe 29, the manual valve 80, and the water header 81 are not required.

In the previous embodiment the nozzle arrangement has been explained as 7 rows and 47 columns but the numbers may be vaned arbitrarily according to the needs of the display fountain.

The jet water may be white because of the bubbles, and the overflow stream and the pond water are pure and transparent so that it is preferred to select the color of the stepwise structure as dark colors such as black, green, red or the like but not bright colors such as white, gray or yellow, etc.

Since the fountain is arranged in stepwise fashion, a vertical line can be seen clearly although the vertical nozzle interval may be large because the water jets can be seen as being connected. However, the horizontal nozzle interval should be made as small as possible so that the adjacent jets are placed not too distant from each other.

Figure 38:
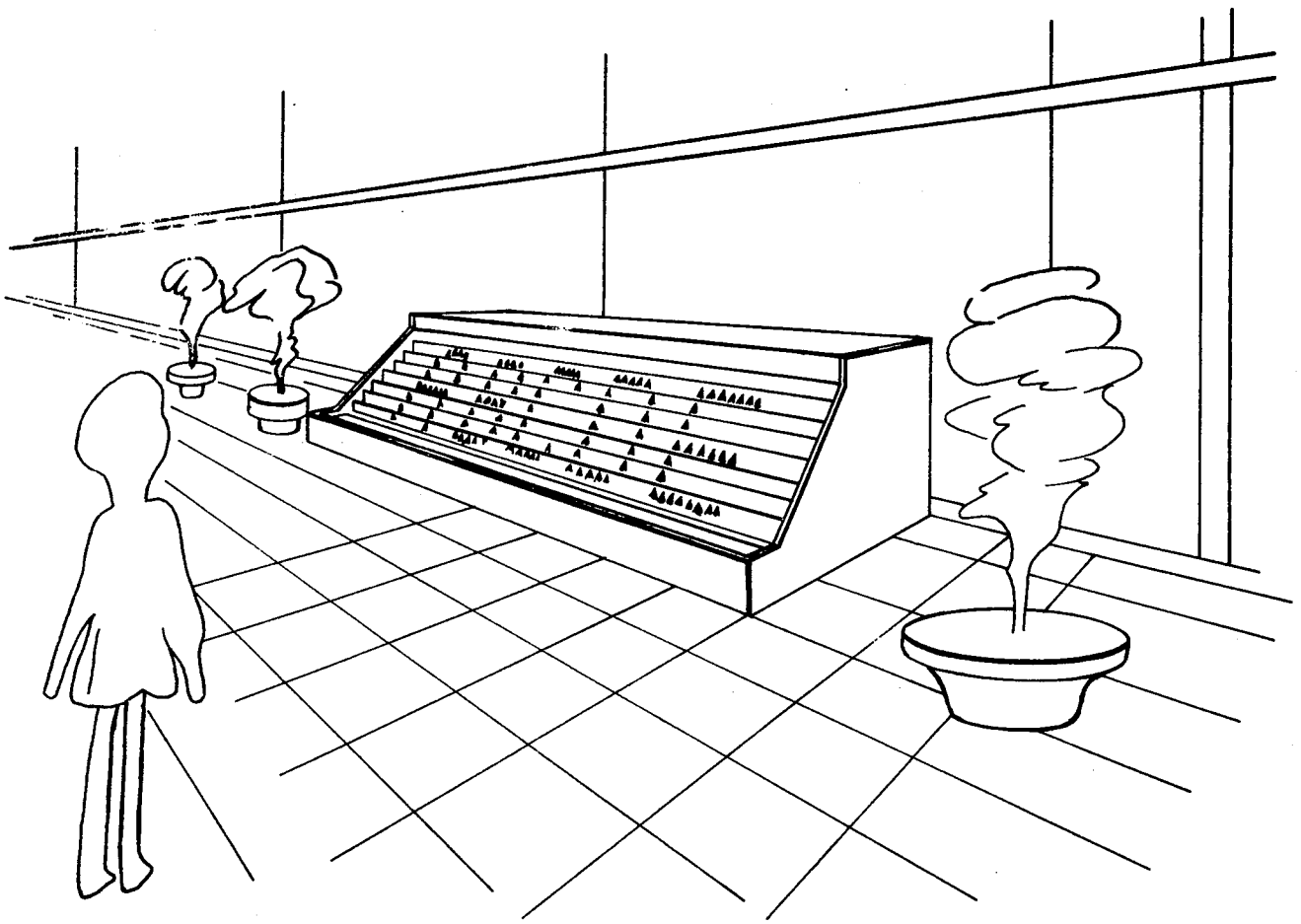
FIG. 38 is a perspective view showing an actual installation of the device according to the present invention.

If the device is small, the whole display device may be made as a package type as shown in FIG. 38. This type can be installed in a very simple manner in a show window. It may also be used as the name plate of a building. It is also suited for installation in a lobby of a hotel or any other place.

The conventional fountain had problems in respect of the scattering of water and limitation in spaces. However, the display device of the present invention can mitigate the above problem and has practical merits in advertisement where small materials are to be used.

The inventive display device having the aforementioned features may thus be used as a novel media for advertisement and provides a new type of fountain.

What is claimed is:

1. A three dimensional water fountain display device comprising a nozzle matrix in which the nozzles thereof are arranged in a series of vertical steps and in aligned relation, said nozzles being thus able upon the discharge of water from selected ones of said nozzles to display desired characters, numerals and other notational representations, an electromagnetic valve operatively connected to each of said nozzles, and a controller circuit associated with each of said valves so as to enable the display of the desired pattern of characters, numerals and other notational representations in three dimension by a combination of selected ones of said nozzles in operation.

2. A three dimensional water fountain display device as claimed in claim 1, including a base pond, said nozzle matrix being positioned so as to extend upwardly above said base pond.

3. A three dimensional water fountain display device as claimed in claim 1, including a base pond and said nozzle matrix comprising a plurality of boxes containing said nozzles arranged above said base pond.

4. A three dimensional water fountain display device as claimed in claim 1, including a plate member provided with a plurality of holes therein in alignment with the nozzles of said matrix positioned in inclined fashion over said matrix.

5. A three dimensional water fountain display device as claimed in claim 4, including a water header positioned above said plate member and adapted to selectively discharge water for flow downwardly across the surface of said plate member.

6. A three dimensional water fountain display device as claimed in claim 1, including a plurality of ponds arranged in vertically stepped relation, the nozzles of said matrix being arranged in said ponds.

7. A three dimensional water fountain display device as claimed in claim 6, including a transparent separating plate positioned in front of each of said ponds.

* * * * *